US010335843B2

(12) United States Patent
Tomizawa et al.

(10) Patent No.: US 10,335,843 B2
(45) Date of Patent: Jul. 2, 2019

(54) METHOD FOR MANUFACTURING BENT MEMBER, AND HOT-BENDING APPARATUS FOR STEEL MATERIAL

(71) Applicant: NIPPON STEEL & SUMITOMO METAL CORPORATION, Tokyo (JP)

(72) Inventors: Atsushi Tomizawa, Nago (JP); Hiroaki Kubota, Toyota (JP); Naoaki Shimada, Futtsu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 203 days.

(21) Appl. No.: 15/504,586

(22) PCT Filed: Aug. 28, 2015

(86) PCT No.: PCT/JP2015/074452

§ 371 (c)(1),
(2) Date: Feb. 16, 2017

(87) PCT Pub. No.: WO2016/031970

PCT Pub. Date: Mar. 3, 2016

(65) Prior Publication Data

US 2017/0232495 A1 Aug. 17, 2017

(30) Foreign Application Priority Data

Aug. 28, 2014 (JP) ..... 2014-174469

(51) Int. Cl.

| | |
|---|---|
| ***B21D 7/08*** | (2006.01) |
| ***B21D 7/16*** | (2006.01) |
| ***B21D 7/12*** | (2006.01) |

(52) U.S. Cl.

CPC ..... *B21D 7/16* (2013.01); *B21D 7/08* (2013.01); *B21D 7/12* (2013.01); *B21D 7/162* (2013.01); *B21D 7/165* (2013.01)

(58) Field of Classification Search

CPC ..... B21D 7/08; B21D 7/12; B21D 7/162
See application file for complete search history.

(56) References Cited

U.S. PATENT DOCUMENTS

| | | | |
|---|---|---|---|
| 4,412,442 | A | 11/1983 | Kawanami et al. |
| 6,097,012 | A | 8/2000 | Shiozuka |

(Continued)

FOREIGN PATENT DOCUMENTS

| | | | |
|---|---|---|---|
| CN | 101638748 | A | 2/2010 |
| CN | 101700542 | A | 5/2010 |

(Continued)

OTHER PUBLICATIONS

International Search Report for PCT/JP2015/074452 (PCT/ISA/210) dated Nov. 24, 2015.

(Continued)

*Primary Examiner* — Debra M Sullivan
(74) *Attorney, Agent, or Firm* — Birch, Stewart, Kolasch & Birch, LLP

(57) ABSTRACT

A method for manufacturing a bent member, the method includes feeding an elongated steel material in a longitudinal direction with one end portion of the steel material as a head, performing high-frequency induction heating to one portion of the steel material in the longitudinal direction by being supplied high-frequency power to form a high-temperature portion, bending the steel material by applying a bending moment in an arbitrary direction to the high-temperature portion to form a bent portion, and injecting a cooling medium to the bent portion to cool the bent portion. The bending includes forming the bent portion having a ratio R/W which is equal to or lower than a predetermined value, where the ratio R/W is a ratio obtained by dividing a bending radius R [mm] of the bent portion on a centroid line of the steel material by a dimension W [mm] in a bend direction in a cross-section of the steel material orthogonal to the cen- (Continued)

troid line, slowing down a feeding speed of the steel material less than V1, where the V1 is the feeding speed of the steel material while forming the bent portion having the ratio R/W which is more than the predetermined value, and reducing the high-frequency power supplied while forming the high-temperature portion less than Q1, where the Q1 is the high-frequency power supplied while forming the bent portion having the ratio R/W which is more than the predetermined value.

4 Claims, 15 Drawing Sheets

(56) References Cited

U.S. PATENT DOCUMENTS

| | | | |
|---|---|---|---|
| 2008/0066517 | A1 | 3/2008 | Tomizawa et al. |
| 2012/0175029 | A1 | 7/2012 | Tomizawa et al. |

FOREIGN PATENT DOCUMENTS

| | | | |
|---|---|---|---|
| CN | 102196869 | A | 9/2011 |
| EP | 0025929 | B1 | 5/1984 |
| EP | 2 359 949 | A1 | 8/2011 |
| EP | 2 368 650 | A1 | 9/2011 |
| JP | 62-18245 | B2 | 4/1987 |
| JP | 11-290955 | A | 10/1999 |
| JP | 3010168 | B2 | 2/2000 |
| JP | 4825019 | B2 | 11/2011 |
| JP | 2012-228714 | A | 11/2012 |
| WO | WO 2006/093006 | A1 | 9/2006 |
| WO | WO 2010/050460 | A1 | 5/2010 |
| WO | WO 2011/007810 | A1 | 1/2011 |

OTHER PUBLICATIONS

Majima et al., "Application of Tube Hydroforming to Automotive Parts", Jidosha Gijutsu, vol. 57, No. 6, 2003, pp. 23-28.

Written Opinion of the International Searching Authority for PCT/JP2015/074452 (PCT/ISA/237) dated Nov. 24, 2015.

Chinese Search Report and Office Action, dated Dec. 4, 2017 for corresponding Chinese Application No. 201580043796.1, with an English translation of the Chinese Search Report.

METHOD FOR MANUFACTURING BENT MEMBER, AND HOT-BENDING APPARATUS FOR STEEL MATERIAL

TECHNICAL FIELD OF THE INVENTION

The present invention relates to a method for manufacturing a bent member and a hot-bending apparatus for a steel material.

Priority is claimed on Japanese Patent Application No. 2014-174469, filed Aug. 28, 2014, the content of which is incorporated herein by reference.

RELATED ART

Metallic strengthening members, reinforcing members, or structural members (hereinafter referred to as bent members) having a bent shape are used for automobiles, various machines, or the like. The bent members are required to be further strengthened and to be lightweight and small-sized. As related-art methods for manufacturing the bent members, for example, welding of press working products, punching of thick plates, and forging are used. However, in the related-art manufacturing methods, further high-strengthening, weight reduction, and size reduction of the bent members may be difficult.

In recent years, manufacturing a bent member using a tube hydroforming method has been positively studied (for example, refer to Non-Patent Document 1). According to the tube hydroforming method, it is possible to reduce the plate thickness of a bent member to be manufactured, improve in shape fixability, and improve in economical efficiency related to manufacture of the bent member are allowed. However, there are problems such that materials that can be used for the tube hydroforming method are limited, and the degrees of freedom in shape are insufficient in bending using the tube hydroforming method.

Methods for manufacturing a bent member and a hot-bending apparatus for a steel material are disclosed in Patent Documents 1 to 3. A method for manufacturing a bent member and a hot-bending apparatus for a steel material that performs hot bending on a steel material in a state where the steel material is clamped by movable roller dies are disclosed in Patent Document 1. A method for manufacturing a bent member and a hot-bending apparatus for a steel material that performs hot bending on a steel material in a state where end parts of a steel material are gripped by chucks are disclosed in Patent Document 2. A method for manufacturing a bent member and a hot-bending apparatus for a steel material that performs hot bending on a steel material in a state where two places of a steel material are gripped by manipulators are disclosed in Patent Document 3.

PRIOR ART DOCUMENT

Patent Document

[Patent Document 1] Japanese Patent No. 4825019

[Patent Document 2] PCT International Publication No. WO2010/050460

[Patent Document 3] PCT International Publication No. WO2011007810

Non-Patent Document

[Non-Patent Document 1] Automobile Technology Vol. 57, No. 6, 2003 Pages 23 to 28

DISCLOSURE OF THE INVENTION

Problems to be Solved by the Invention

In the methods for manufacturing a bent member and the hot-bending apparatus for a steel material disclosed in Patent Documents 1 to 3, the outside of a bent portion of a steel material is not appropriately cooled. Therefore, uneven quenching may occur. Additionally, in a case where bending with a small bending radius is performed using the methods for manufacturing a bent member and the hot-bending apparatus for a steel material disclosed in Patent Documents 1 to 3, wrinkle or cross-sectional distortion may occur.

Moreover, in the methods for manufacturing a bent member and the hot-bending apparatus for a steel material, further improvements in productivity and economical efficiency are required.

The invention has been made in view of the above circumstances, and an object thereof is to provide a method for manufacturing a bent member and a hot-bending apparatus for a steel material that can reduce occurrence of uneven quenching, and wrinkle and cross-sectional distortion and is excellent in productivity and economical efficiency, even in a case where a bent member having a small bending radius is manufactured.

Means for Solving the Problems

The invention adopts the following means in order to solve the above problems to achieve the relevant object.

(1) A method for manufacturing a bent member related to an aspect of the invention includes feeding an elongated steel material in a longitudinal direction with one end portion of the steel material as a head, performing high-frequency induction heating to one portion of the steel material in the longitudinal direction by being supplied high-frequency power to form a high-temperature portion, bending the steel material by applying a bending moment in an arbitrary direction to the high-temperature portion to form a bent portion, and injecting a cooling medium to the bent portion to cool the bent portion.

The bending includes forming the bent portion having a ratio R/W which is equal to or lower than a predetermined value, where the ratio R/W is a ratio obtained by dividing a bending radius R [mm] of the bent portion on a centroid line of the steel material by a dimension W [mm] in a bend direction in a cross-section of the steel material orthogonal to the centroid line, slowing down a feeding speed of the steel material less than V1, where the V1 is the feeding speed of the steel material while forming the bent portion having the ratio R/W which is more than the predetermined value, and reducing the high-frequency power supplied while forming the high-temperature portion less than Q1, where the Q1 is the high-frequency power supplied while forming the bent portion having the ratio R/W which is more than the predetermined value.

(2) In the method for manufacturing a bent member described in the above (1), the predetermined value of the ratio R/W may be a value selected from within a range of 3.0 to 8.0.

(3) In the method for manufacturing a bent member described in the above (1) or (2), the feeding speed of the steel material while forming the bent portion of which the ratio R/W is equal to or lower than the predetermined value may be lowered to 25% to 75% of the V1 in the bending step.

(4) In the method for manufacturing a bent member described in any one of the above (1) to (3), the high-frequency power supplied while forming the bent portion of which the ratio R/W is equal to or lower than the predetermined value may be lowered to 25% to 75% of the Q1 in the bending step.

(5) A hot-bending apparatus for a steel material related to another aspect of the invention includes a feeding mechanism that feeds an elongated steel material in a longitudinal direction with one end portion of the steel material in the longitudinal direction as a head; an induction heating mechanism that performs high-frequency induction heating on one portion of the steel material in the longitudinal direction by being supplied high-frequency power and thereby forming a high-temperature portion; a bending mechanism that applies a bending moment in an arbitrary direction to the high-temperature portion and forms a bent portion; a cooling mechanism that injects a cooling medium on the bent portion and thereby cools the bent portion; and a controller that controls the feeding mechanism, the induction heating mechanism, the bending mechanism, and the cooling mechanism such that a feeding speed of the steel material is slower than V1 and the high-frequency power is lower than Q1 while forming the bent portion having a ratio R/W which is equal to or lower than a predetermined value, where the V1 is the feeding speed of the steel material while forming the bent portion having the ratio R/W which is more than the predetermined value, the Q1 is the high-frequency power supplied to the induction heating mechanism, and the ratio R/W is a ratio obtained by dividing a bending radius R [mm] of the bent portion on a centroid line of the steel material by a dimension W [mm] in a bend direction in a cross-section of the steel material orthogonal to the centroid line.

(6) In the hot-bending apparatus for a steel material described in the above (5), the predetermined value of the ratio R/W may be a value selected from within a range of 3.0 to 8.0.

(7) The hot-bending apparatus for a steel material described in the above (5) or (6), the controller may control the feeding mechanism such that the feeding speed of the steel material while forming the bent portion of which the ratio R/W is equal to or lower than the predetermined value is lowered to 25% to 75% of the V1.

(8) The hot-bending apparatus for a steel material described in any one of the above (5) to (7), the controller may control the induction heating mechanism such that the high-frequency power supplied while forming the bent portion of which the ratio R/W is equal to or lower than the predetermined value is lowered to 25% to 75% of the Q1.

Effects of the Invention

According to the above respective aspects, it is possible to provide a method for manufacturing a bent member and a hot-bending apparatus for a steel material that can suppress occurrence of uneven quenching, and wrinkle and cross-sectional distortion and is excellent in productivity and economical efficiency, even in a case where a bent member having a small bending radius is manufactured.

Figure 7A:
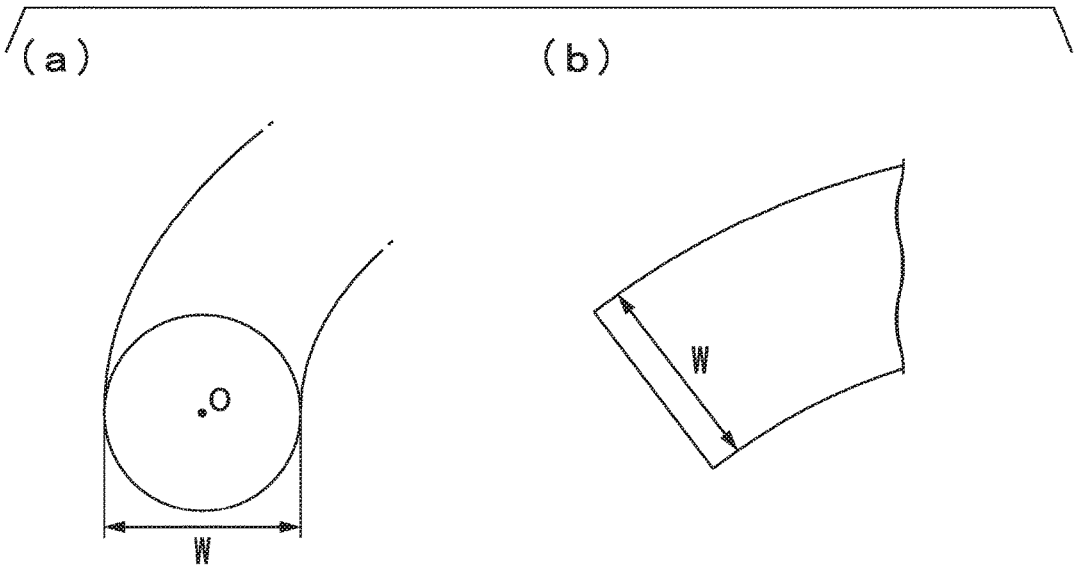

(a) of FIG. 7A is a schematic view showing a centroid O and a width dimension W in a case where a tip portion of a bent member with a circular sectional shape is seen from an opposed sight line, and (b) of FIG. 7A is a view of the bent portion of the bent member with the circular sectional shape as looked down perpendicularly to a bending plane.

Figure 7B:
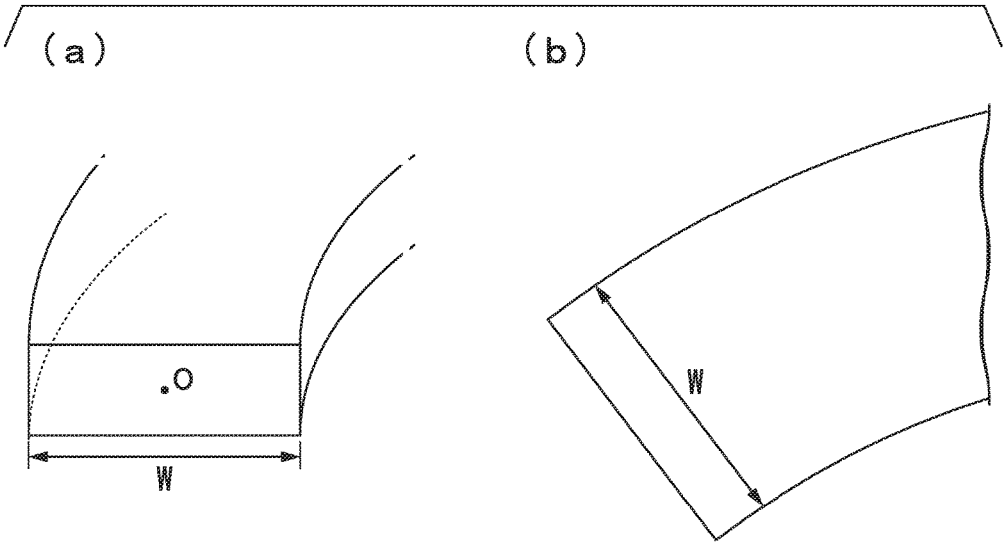

(a) of FIG. 7B is a schematic view showing the centroid O and the width dimension W in a case where the tip portion of the bent member with a rectanglar sectional shape is seen from the opposed sight line, and (b) of FIG. 7B is a view of the bent portion of the bent member with the rectanglar sectional shape as looked down perpendicularly to the bending plane.

Figure 7C:
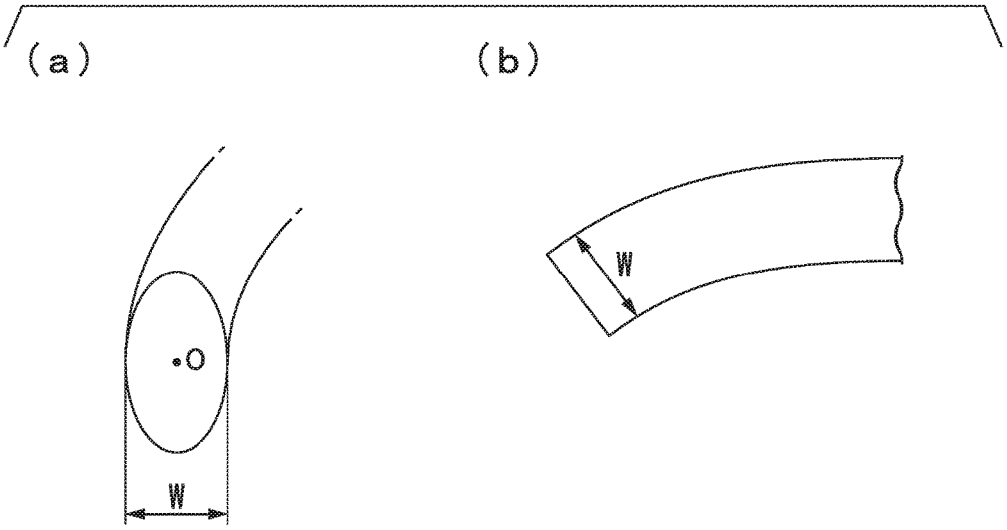

(a) of FIG. 7C is a schematic view showing the centroid O and the width dimension W in a case where the tip portion of the bent member with an elliptical sectional shape is seen from the opposed sight line, and (b) of FIG. 7C is a view of the bent portion of the bent member with the elliptical sectional shape as looked down perpendicularly to a bending plane.

Figure 7D:
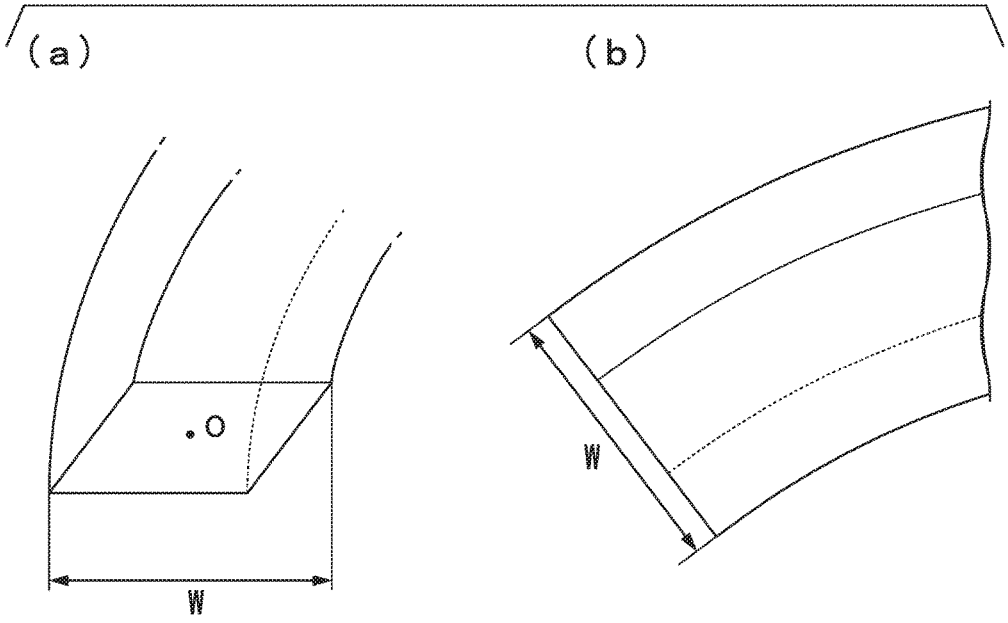

(a) of FIG. 7D is a schematic view showing the centroid O and the width dimension W in a case where the tip portion of the bent member with a parallelogrammic sectional shape is seen from the opposed sight line, and (b) of FIG. 7D is a view of the bent portion of the bent member with the parallelogrammic sectional shape as looked down perpendicularly to the bending plane.

Figure 7E:
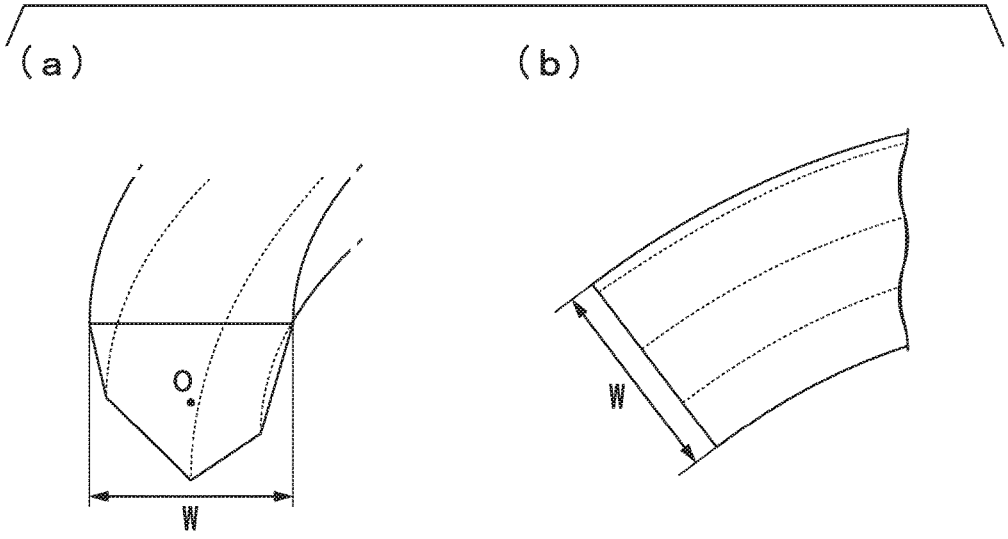

(a) of FIG. 7E is a schematic view showing the centroid O and the width dimension W in a case where the tip portion of the bent member with a pentagonal sectional shape is seen from the opposed sight line, and (b) of FIG. 7E is a view of the bent portion of the bent member with the pentagonal sectional shape as looked down perpendicularly to the bending plane.

Figure 7F:
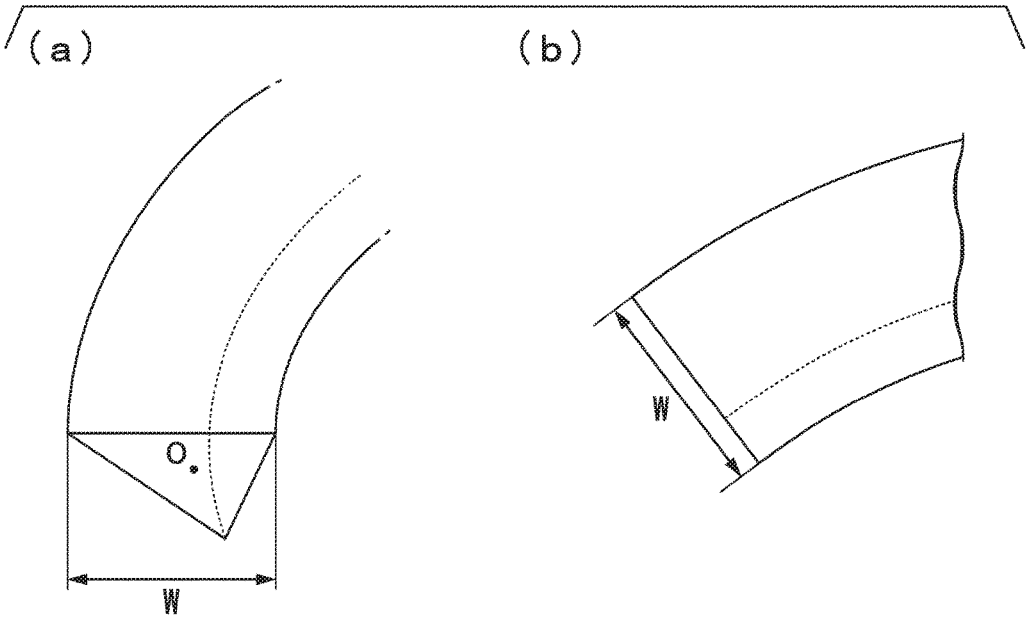

(a) of FIG. 7F is a schematic view showing the centroid O and the width dimension W in a case where the tip portion of the bent member with a triangular sectional shape is seen from an opposed sight line, and (b) of FIG. 7F is a view of the bent portion of the bent member with the triangular sectional shape as looked down perpendicularly to the bending plane.

Figure 8:
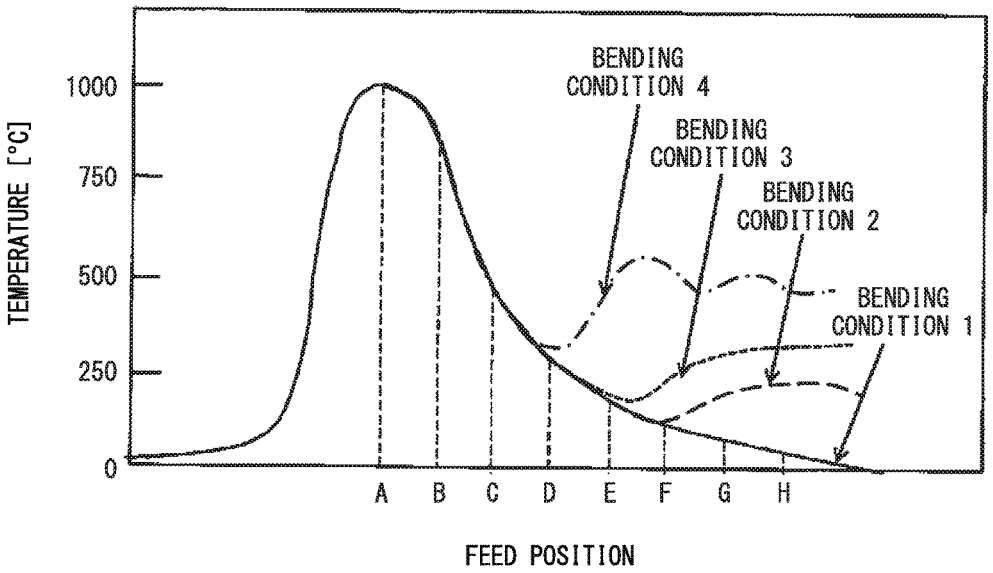

FIG. 8 shows measurement results of the surface temperature of the outside of the bent portion of the steel pipe in the bending shown in FIGS. 6B to 6E.

Figure 9:
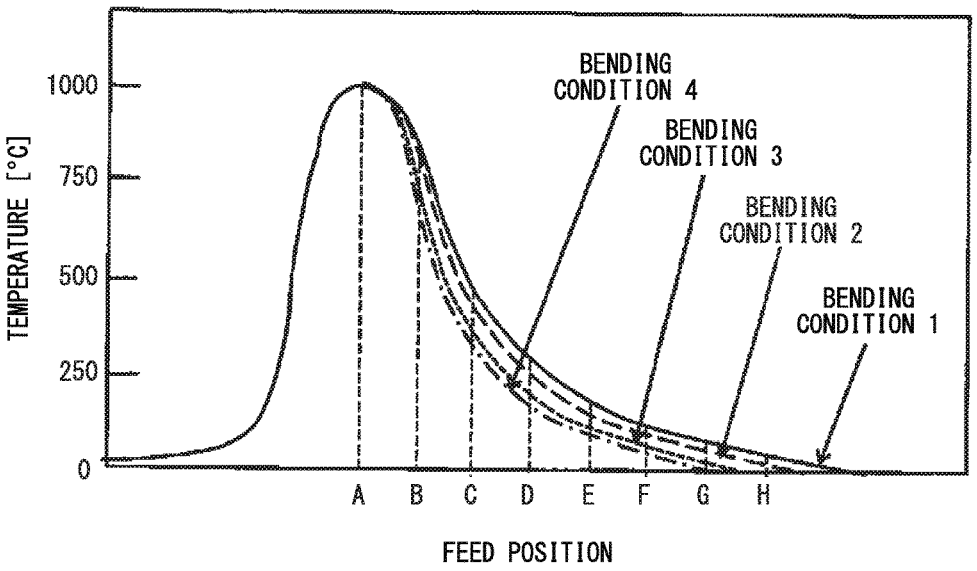

FIG. 9 shows measurement results of the surface temperature of the inside of the bent portion of the steel pipe in the bending shown in FIGS. 6B to 6E.

Figure 10:
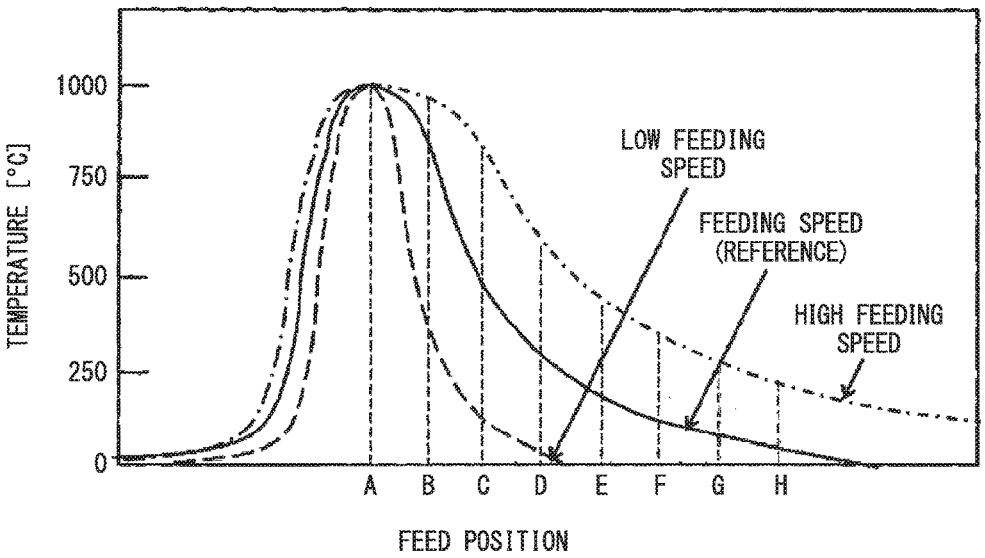

FIG. 10 is a graph showing a relationship between the surface temperature of a certain point and the feed position of a steel pipe in a case where only quenching is performed to the steel pipe without performing bending.

Figure 11A:
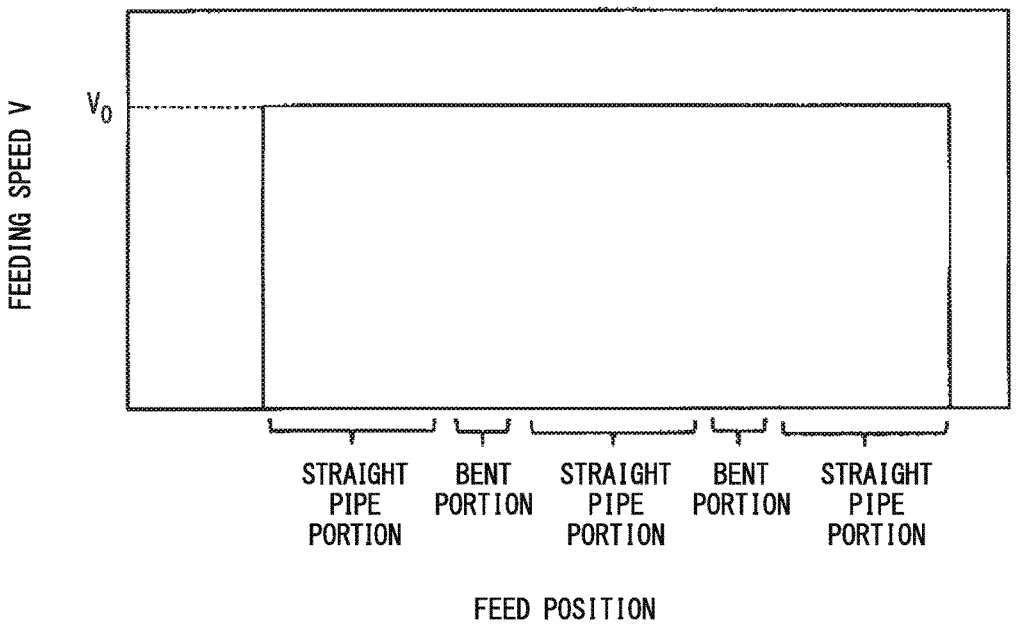

FIG. 11A is a graph showing a pattern of the feeding speed of a steel pipe in Comparative Example 2-1.

Figure 11B:
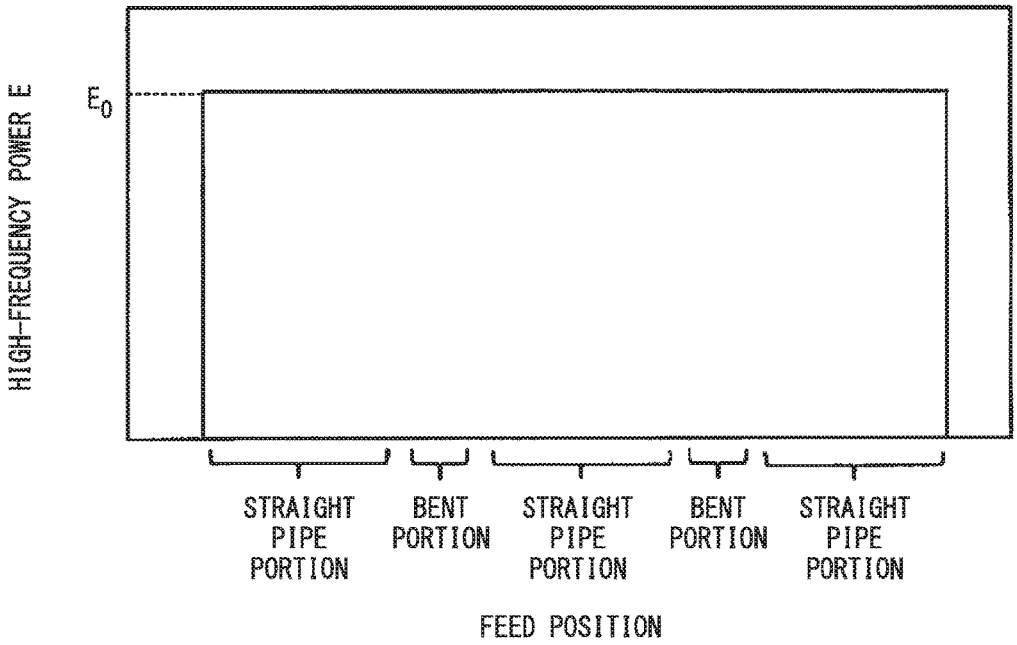

FIG. 11B is a graph showing a pattern of high-frequency power supplied to the induction heating device in Comparative Example 2-1.

Figure 12A:
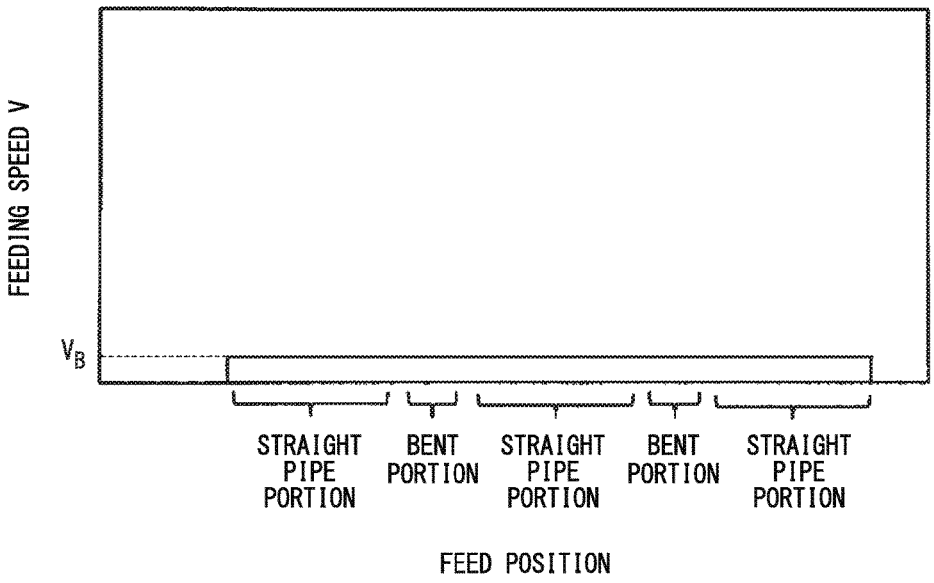

FIG. 12A is a graph showing a pattern of the feeding speed of a steel pipe in Comparative Example 2-2.

Figure 12B:
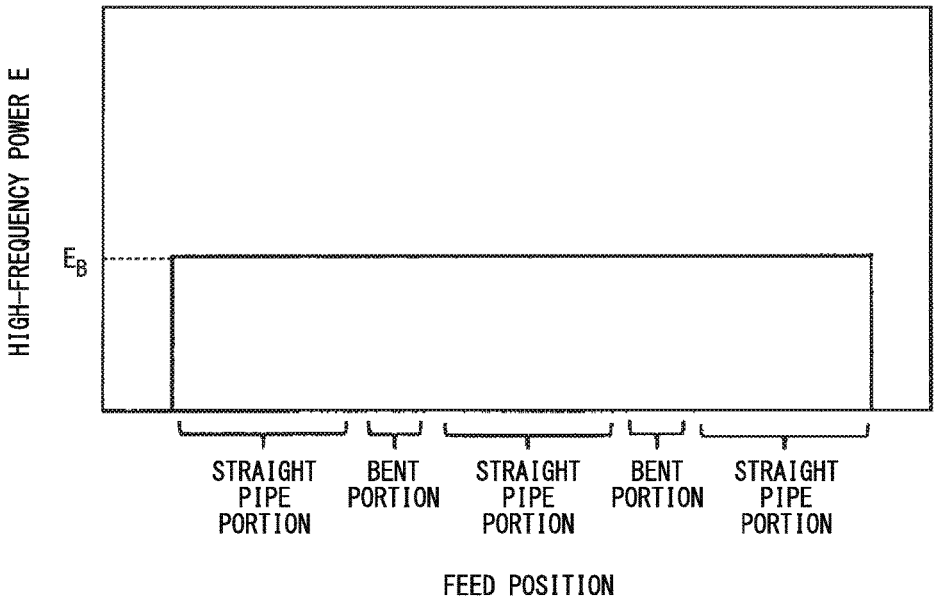

FIG. 12B is a graph showing a pattern of high-frequency power supplied to the induction heating device in Comparative Example 2-2.

Figure 13:
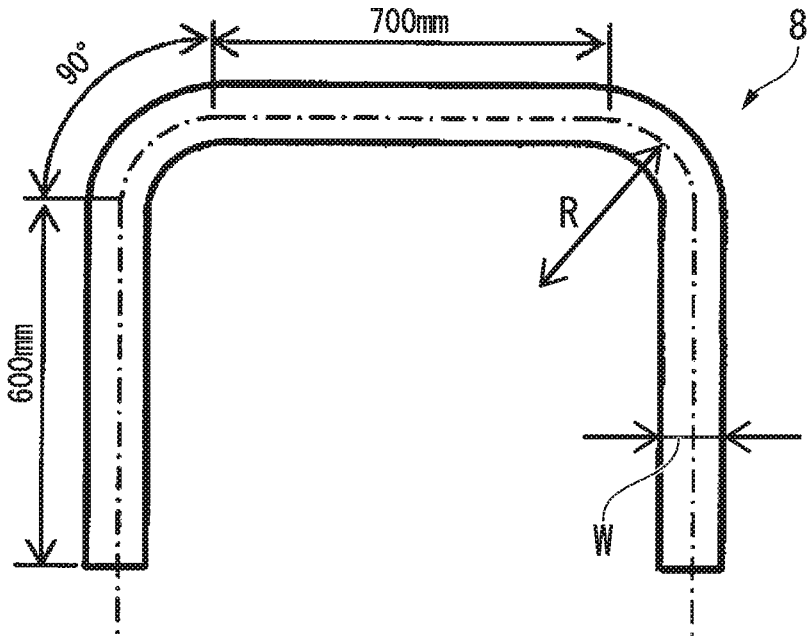

FIG. 13 is a schematic view showing the shape of the bent members manufactured in Example 2-1, Comparative Example 2-1, and Comparative Example 2-2.

Figure 14A:
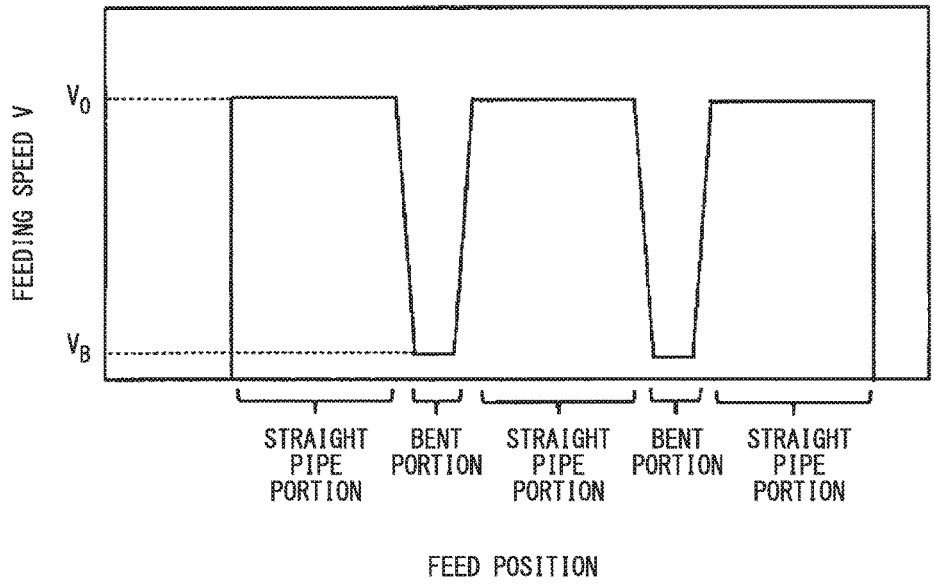

FIG. 14A is a graph showing a pattern of the feeding speed of a steel pipe in Example 2-1.

Figure 14B:
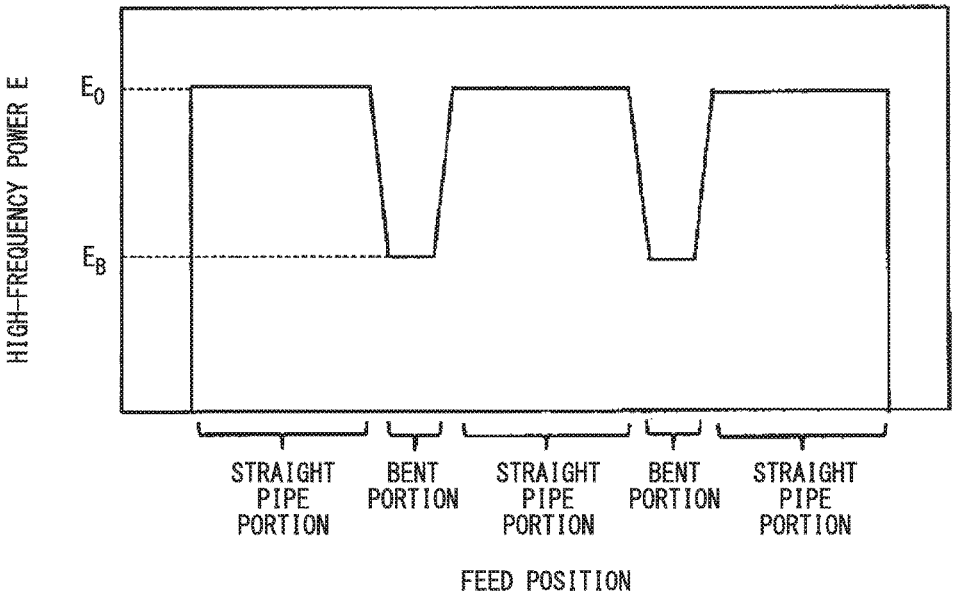

FIG. 14B is a graph showing a pattern of high-frequency power supplied to the induction heating device in Example 2-1.

EMBODIMENTS OF THE INVENTION

Hereinafter, a method for manufacturing a bent member and a hot-bending apparatus for a steel material related to an embodiment of the present invention will be described with reference to the drawings.

(Hot-Bending Apparatus for Steel Material)

Figure 1:
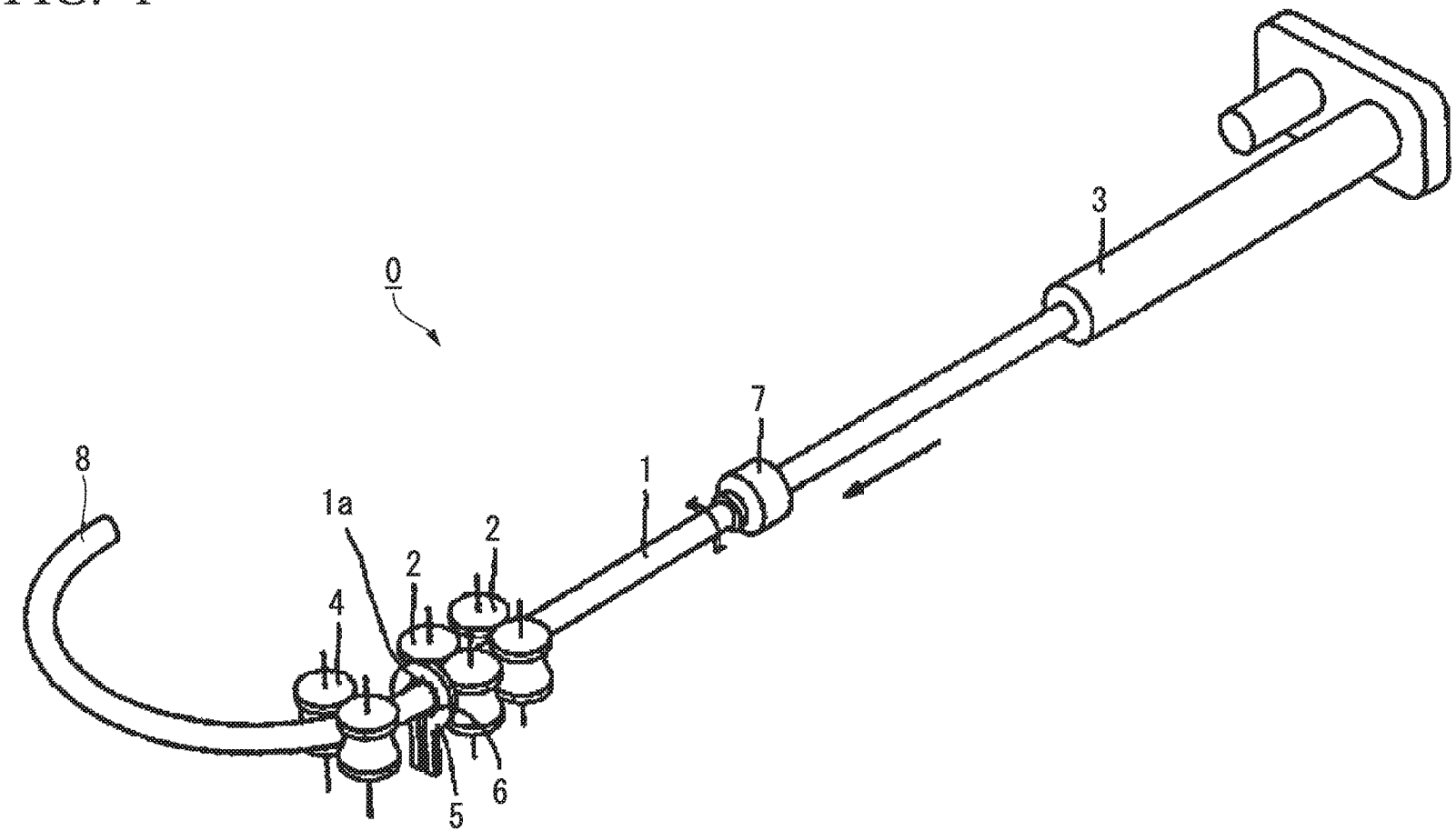
FIG. 1 is a plan view showing a bending apparatus related to the present embodiment.

A hot-bending apparatus 0 for a steel material shown in FIG. 1 includes a gripping device (gripping mechanism) 7, an induction heating device (induction heating mechanism) 5, a cooling device (cooling mechanism) 6, a feeding device (feeding mechanism) 3, a bending device (bending mechanism), and a control device (not shown), and performs hot bending to a steel pipe (steel material) 1.

In addition, in the hot-bending apparatus 0 for a steel material shown in FIG. 1, a support device 2 and a movable roller dies 4 constitute the bending device.

Specifically, the steel pipe 1 is rapidly heated in a temperature zone where it is possible to perform partial quenching, by an annular induction heating device 5 that surrounds an outer periphery of the steel pipe 1 downstream of the support device 2. Accordingly, a high-temperature portion (red heat portion) 1*a* that moves in the longitudinal direction of the steel pipe 1 is formed in the steel pipe 1.

Thereafter, the position of the movable roller dies 4 that has at least one set of roll pair capable of supporting the steel pipe 1 while feeding the steel pipe is moved in an arbitrary direction, and a bending moment is applied to the high-temperature portion 1*a*.

Thereafter, a cooling medium, such as cooling water, is injected from the cooling device 6 disposed downstream of the induction heating device 5 to the steel pipe 1 to rapidly cool the heated steel pipe 1. Accordingly, bending is performed to the steel pipe 1, and the bent member 8 is manufactured.

When bending is performed to the steel pipe 1, the steel pipe 1 can be quenched by controlling the heating temperature and the cooling rate of the steel pipe 1. For this reason, according to the method for manufacturing a bent member 8 using the hot-bending apparatus 0 for a steel material, it is possible to achieve high strength, weight reduction, and size reduction of the bent member 8.

In addition, in the present embodiment, the method for manufacturing the bent member 8 using the hot-bending apparatus 0 for a steel material is referred to as 3DQ (abbreviation of "3 Dimensional Hot Bending and Quench").

[Steel Pipe (Steel Material)]

The elongated steel pipe 1 that is a target for bending is not particularly limited. As an example of the material of the steel pipe 1, carbon steel that contains 0.15 mass % to 0.25 mass % of C is preferable, and particularly carbon steel that contains 0.2 mass % of C is preferable. An example of the plate thickness of the steel pipe 1 is 0.8 mm to 4 mm.

In addition, the sectional shape of the steel pipe 1 is not limited to the circular shape, and may be other sectional shapes.

FIGS. 7A to 7F are schematic views showing a centroid O and a width dimension W in a case where a tip portion of the bent member 8 seen from an opposed sight line and views of the bent portion of the bent member 8 as looked down perpendicularly to a bending plane, according to the sectional shapes of the bent member 8. In addition, FIG. 7A shows a case where the sectional shape of the steel pipe 1 is a circular shape, FIG. 7B shows a case where the sectional shape of the steel pipe 1 is a rectanglar shape, FIG. 7C shows a case where the sectional shape of the steel pipe 1 is an elliptical shape, FIG. 7D shows a case where the sectional shape of the steel pipe 1 is a parallelogrammic shape, FIG. 7E shows a case where the sectional shape of the steel pipe 1 is a pentagonal shape, and FIG. 7F shows a case where the sectional shape of the steel pipe 1 is a triangular shape.

As shown in FIGS. 7A to 7F, a dimension in a bend direction in a cross-section of the steel pipe 1 orthogonal to a centroid line is referred to W in the present embodiment. In addition, the dimension in the bend direction in the cross-section of the steel pipe 1 orthogonal to the centroid line means the width dimension of the steel pipe 1 when the bent portion is seen from a sight line along a centerline of curvature of bending thereof. Additionally, the centerline of curvature of bending means the centerline of a circular arc in a case where the bending is approximated as a portion of the circular arc.

The above-described width dimension W is 10 mm to 100 mm, for example.

[Gripping Device (Gripping Mechanism)]

The gripping device 7 grips at least one of one end portion (tip portion) and the other end portion (rear end portion) of the steel pipe 1. An example of the gripping device 7 is a chuck.

[Induction Heating Device (Induction Heating Mechanism)]

The induction heating device 5 has an annular outer shape, and is disposed so as to surround the steel pipe 1 from a position apart at a predetermined distance from an outer peripheral surface of the steel pipe 1. The induction heating device 5 is supplied high-frequency power from a high-frequency power generating device (not shown), thereby rapidly heating one portion of the steel pipe 1 to a desired temperature equal to or higher than an Ac3 point for a short time (about 2 seconds), and forming the high-temperature portion (red heat portion) 1*a* in the steel pipe 1.

In addition, since the heating amount of the steel pipe 1 can be adjusted by adjusting the high-frequency power supplied to the induction heating device 5, it is possible to adjust the highest arrival temperature of the steel pipe 1. In the present embodiment, the high-frequency power supplied to the induction heating device 5 is adjusted such that the highest arrival temperature of the steel pipe 1 is 900° C. to 1050° C.

[Cooling Device (Cooling Mechanism)]

Figure 2:
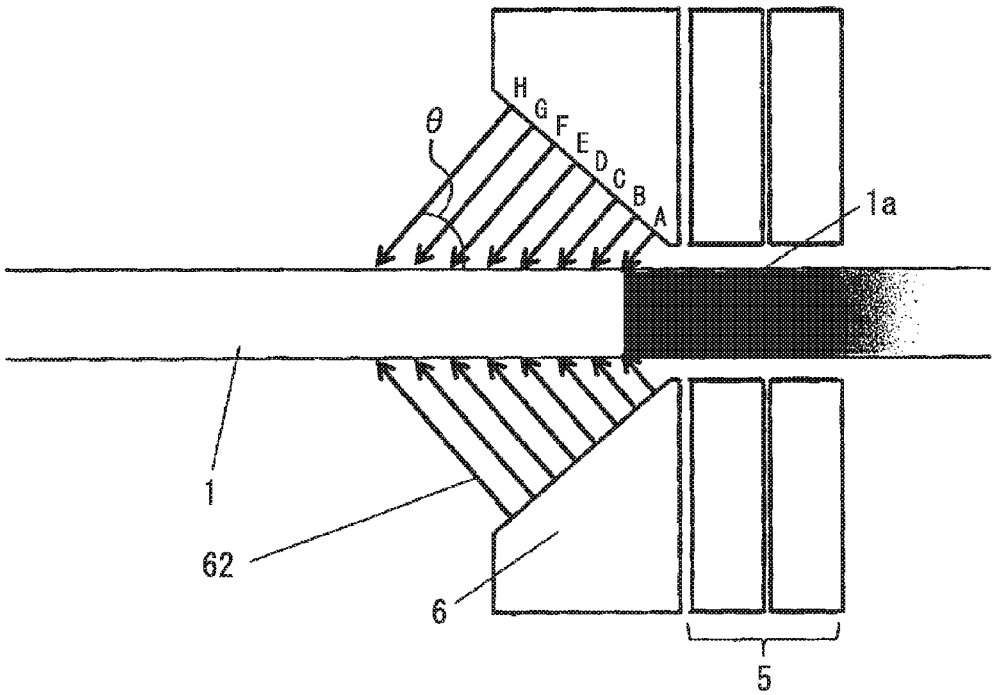
FIG. 2 is an explanatory view showing a heating method and a cooling method for a steel material related to the present embodiment as seen along a feed direction of the steel material.

As shown in FIGS. 1 and 2, the cooling device 6 is disposed at the downstream side in the feed direction of the steel pipe 1 than the induction heating device 5, and injects a cooling medium 62. The cooling medium 62 is preferably liquid, and cooling water is an example of the cooling medium 62.

Figure 3:
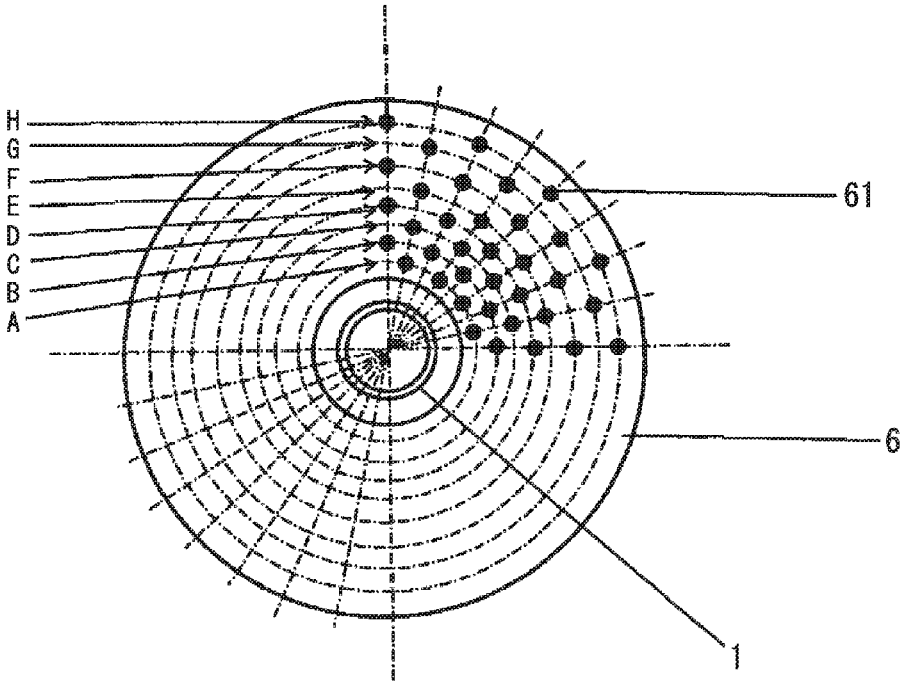
FIG. 3 is a front view showing a cooling device related to the present embodiment.

As shown in FIGS. 2 and 3, eight rows of injecting holes 61 are concentrically provided from the inside in the cooling device 6. As shown in FIG. 3, the rows of the injecting holes 61 are respectively referred to as row A, row B, row C, row D, row E, row F, row G, and row H in order from the inside row thereof.

The cooling device 6 injects the cooling medium 62 to an outer surface of the steel pipe 1, which is heated by the induction heating device 5, from the respective injecting holes 61 obliquely to the downstream side in the feed direction of the steel pipe 1.

Although the temperature of the cooling medium 62 injected from the cooling device 6 is not particularly limited, in order to appropriately cool the steel pipe 1 after heating, 5° C. to 25° C. is preferable as the temperature of the cooling medium 62.

Although the hole diameter of the injecting holes 61 in the cooling device 6 is not particularly limited, 1.5 mm to 3.0 mm is preferable and 1.8 mm is particularly preferable.

Although the injecting velocity of the cooling medium 62 injected from the injecting holes 61 is not particularly limited, in order to appropriately cool the steel pipe 1, 3 m/sec to 12 m/sec is preferable, and 4 m/sec to 6 m/sec is particularly preferable.

Although the injecting angle (the collision angle of the cooling medium 62 to the steel pipe 1) of the cooling medium 62 in the feed direction of the steel pipe 1 is not particularly limited, 15° to 70° is preferable, and 30° is particularly preferable.

[Feeding Device (Feeding Mechanism)]

The feeding device 3 is a device that feeds the steel pipe 1 in the longitudinal direction relatively to the induction heating device 5 and the cooling device 6. As the feeding device 3, a device having the function of feeding the steel pipe 1 in the longitudinal direction may be used, or a device having the function of feeding the induction heating device 5 and the cooling device 6 in the longitudinal direction of the steel pipe 1 may be used.

An example of the device having the function of feeding the steel pipe 1 in the longitudinal direction includes a device that feeds the steel pipe 1 in the longitudinal direction using a ball screw, and an industrial robot that feeds the steel pipe 1 in the longitudinal direction in a state where the steel pipe 1 is gripped.

An example of the device having the function of feeding the induction heating device 5 and the cooling device 6 in the longitudinal direction of the steel pipe 1 includes an industrial robot that feeds the induction heating device 5 and the cooling device 6 in the longitudinal direction of the steel pipe 1 in a state where the induction heating device 5 and the cooling device 6 are supported.

[Bending Device (Bending Mechanism)]

The bending device is a device that applies a bending moment in an arbitrary direction to the high-temperature portion 1*a*. When the bending device applies the bending moment in an arbitrary direction to the high-temperature portion 1*a*, a bent portion that is bent in two-dimensional directions (for example, S-shaped bending) or three-dimensional directions is formed on the steel pipe 1.

Figure 6A:
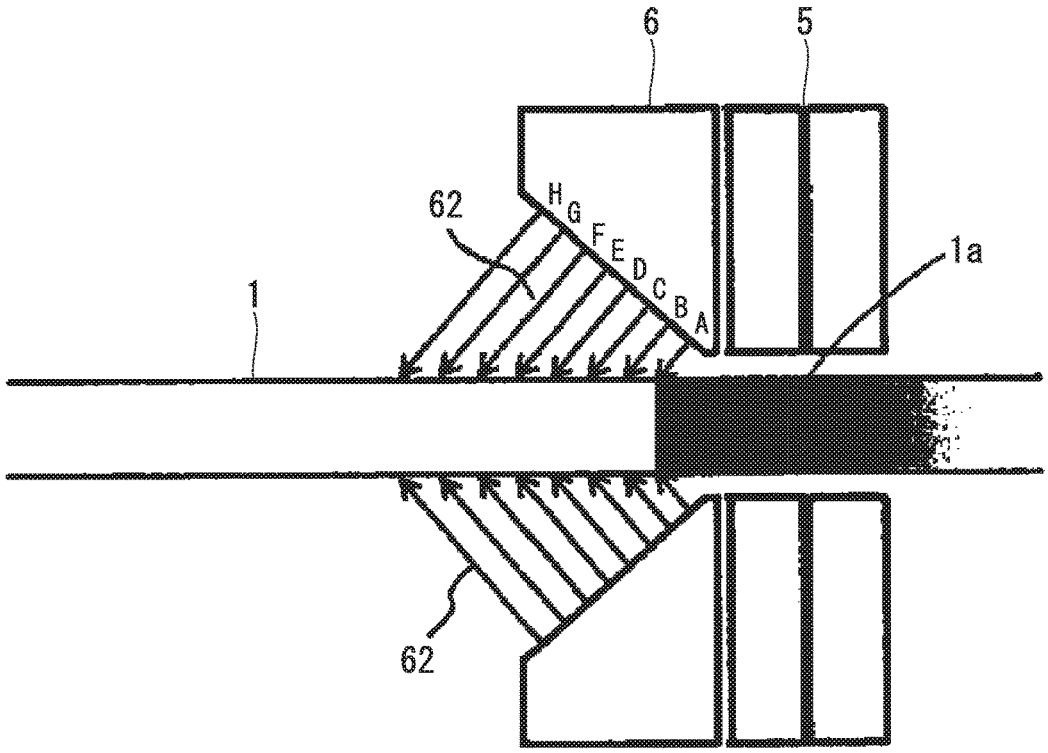
FIG. 6A is a plan view showing the state of cooling of the steel pipe by the cooling device when bending is not performed to the steel pipe.
Figure 6B:
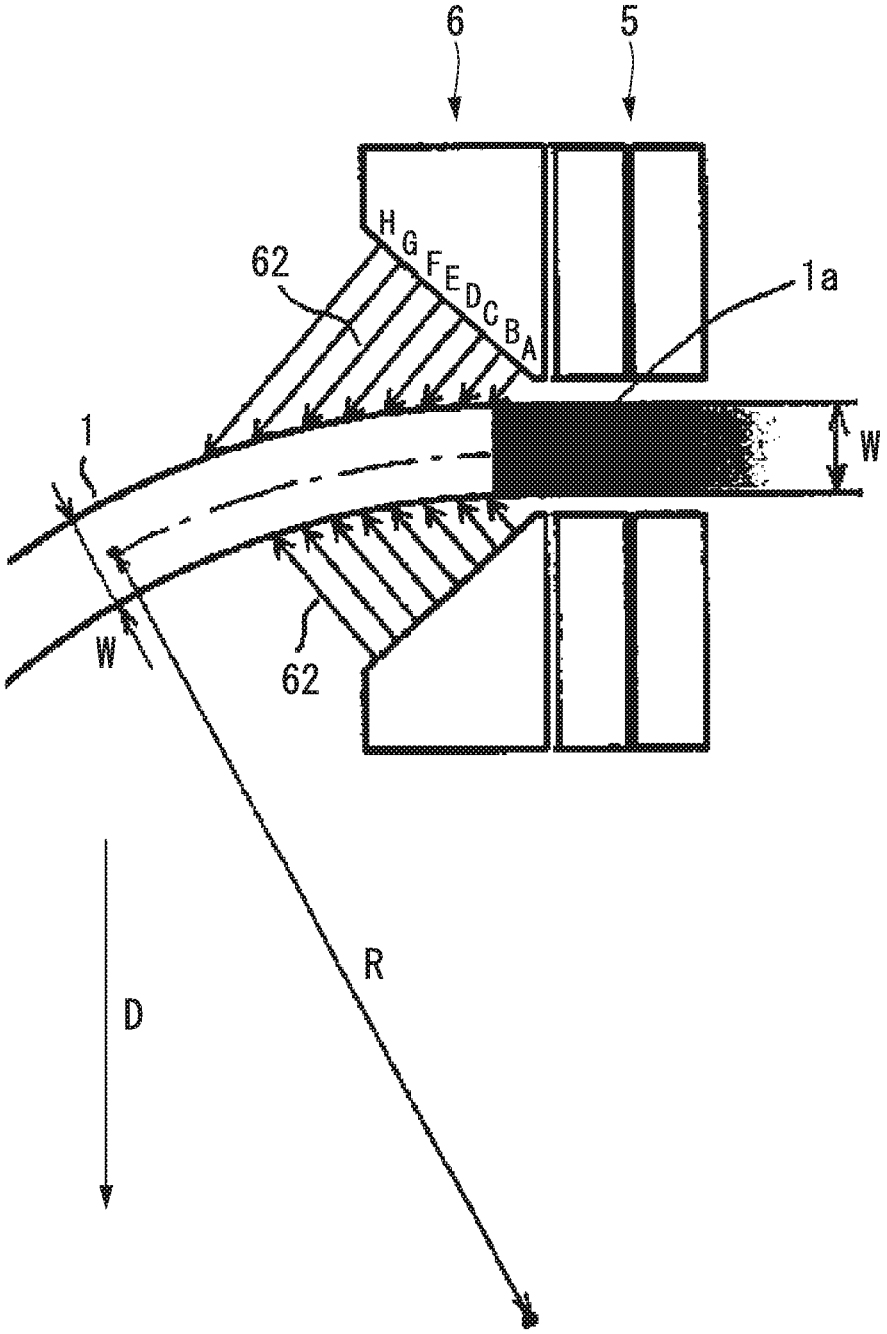
FIG. 6B is a plan view showing the state of cooling of the steel pipe by the cooling device in a case where bending with a bending radius R is performed to the steel pipe.

As shown in FIG. 6B, the bending device bends the steel pipe 1 in a bending direction D with a bending radius R. In the present embodiment, the bending radius R represents a bending radius on the centroid line of the steel pipe 1.

Next, the results of the study that has led to the knowledge of the present invention will be described.

Figure 4:
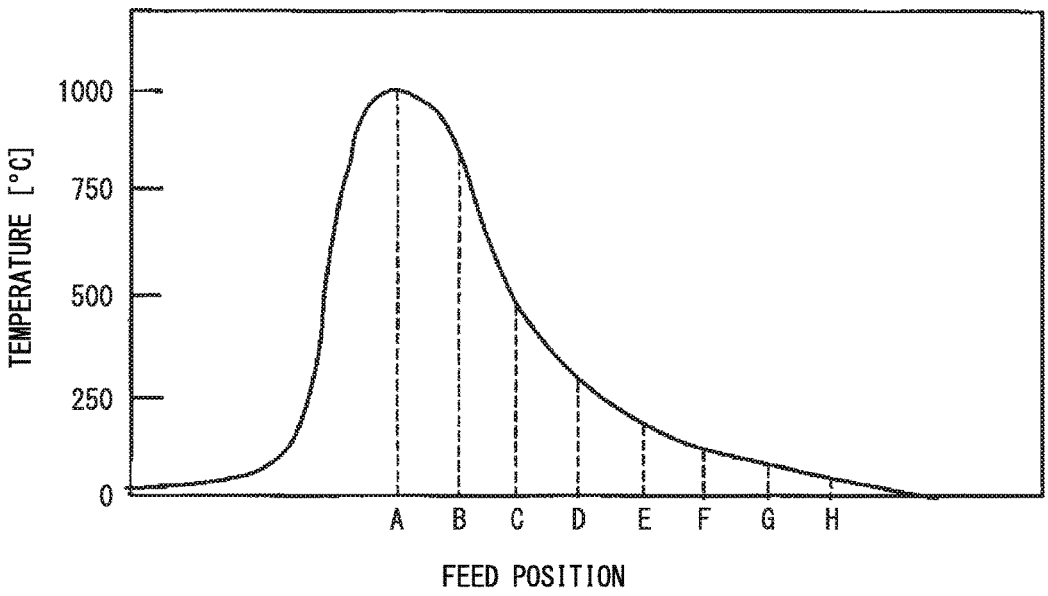
FIG. 4 is a graph showing a relationship between the feed position of a steel pipe and the surface temperature of the steel pipe in a case where only heating and cooling are performed to the steel pipe without performing bending, using an induction heating device and the cooling device.

FIG. 4 shows a relationship between the feed position of the steel pipe 1 and the surface temperature of the steel pipe 1 in a case where only heating and cooling are performed to the steel pipe 1 without performing bending, using the induction heating device 5 and the cooling device 6. A to H shown on the horizontal axis of FIG. 4 represent points where the cooling medium 62 injected from the injecting holes 61 in the rows A to H collides against the surface of the steel pipe 1. The vertical axis of FIG. 4 represents surface temperature at respective feed positions when a certain point located on the surface of the steel pipe 1 are fed in the longitudinal direction with the tip portion of the steel pipe 1 as a head.

As shown in FIG. 4, the surface temperature of the steel pipe 1 is rapidly heated to about 1000° C. by the induction heating device 5, and a highest arrival temperature is shown in the vicinity of point A. Thereafter, the steel pipe 1 is cooled by the cooling medium 62 injected from the injecting holes 61 in the rows B to H together with the feed of the steel pipe 1. Under the conditions of FIG. 4, the temperature of the steel pipe 1 falls substantially to room temperature in the vicinity of point H.

Next, bending is performed to the steel pipe 1 with various bending radii R, using the hot-bending apparatus 0 for a steel material, and the bent member 8 is manufactured.

FIG. 6A is a plan view showing the state of cooling of the steel pipe 1 by the cooling device 6 when bending is not performed to the steel pipe 1. FIGS. 6B to 6E are plan views showing the state of cooling of the steel pipe 1 by the cooling device 6 in a case where bending with the bending radius R is performed to the steel pipe 1, and the bending radius R becomes smaller as proceeding from FIG. 6B to FIG. 6E.

As shown in FIGS. 6A to 6E, not only in a case where bending is not performed to the steel pipe 1, but also in a case where bending is performed to the steel pipe 1 with the bending radius R, it is possible to cool the steel pipe 1 with the cooling medium 62 injected from the injecting holes 61 provided in the cooling device 6.

Measurement results of the surface temperature of the outside of the bent portion in the steel pipe 1 in bending shown in FIGS. 6B to 6E are shown in FIG. 8, and the measurement results of the surface temperature of the inside of the bent portion are shown in FIG. 9.

Figure 5:
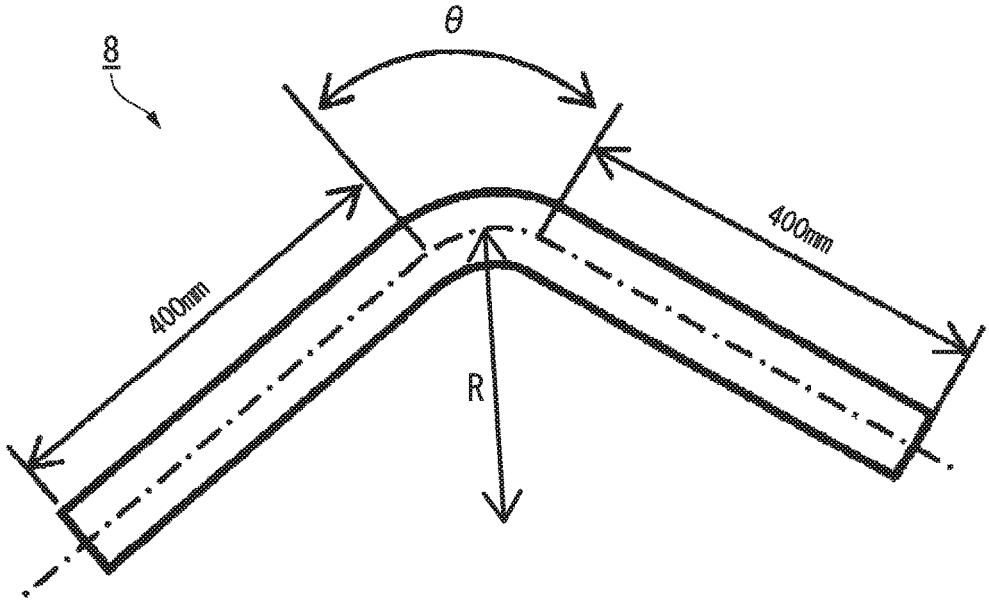
FIG. 5 is an explanatory view showing the shape of a bent member manufactured in a bending test.

In addition, bending conditions 1 to 4 in FIGS. 8 and 9 respectively correspond to the bending conditions shown in FIGS. 6B to 6E. Additionally, an example of the shape of the bent member 8 manufactured according to the bending conditions of FIGS. 8 and 9 is shown in FIG. 5.

As shown in FIG. 8, as a measurement result of the surface temperature of the outside of the bent portion of the steel pipe 1 under a bending condition 1, the same result as the measurement result of the surface temperature in a case where bending is not performed to the steel pipe 1 shown in FIG. 4 was obtained.

Meanwhile, the surface temperature of the outside of the bent portion of the steel pipe 1 in the case of the bending conditions 2 to 4 was different from that under the bending condition 1, as shown in FIG. 8. Specifically, the surface temperatures at points D to H under the bending conditions 2 to 4 were higher than that under the bending condition 1 at the outside of the bent portion.

Meanwhile, as shown in FIG. 9, there are no big differences in the surface temperature of the inside of the bent portion of the steel pipe 1 due to the bending conditions.

It is considered as a reason why the surface temperature at the outside of the bent portion of the steel pipe 1 varies due to the bending conditions, whereas a large difference is not caused in the surface temperature at the inside of the bent portion of the steel pipe 1 due to the bending conditions, the angles of collision of the cooling medium 62 injected from respective injecting holes 61 against the surface of the steel pipe 1 are different from each other between inside and outside of the bent portion of the steel pipe 1.

Specifically, the angle of collision of the cooling medium 62 against the surface of the steel pipe 1 is large at the inside of the bent portion. Therefore, the pressure of collision of the cooling medium 62 against the surface of the steel pipe 1 is large, and the water amount density of the cooling medium 62 becomes high.

On the other hand, the angle of collision of the cooling medium 62 against the surface of the steel pipe 1 is small at the outside of the bent portion. Therefore, the pressure of collision of the cooling medium 62 against the surface of the steel pipe 1 is small, and the injected water density of the cooling medium 62 becomes low.

From the above-described reason, the cooling rate of the inside of the bent portion is larger compared to that of the outside of the bent portion in the steel pipe 1.

Figure 6C:
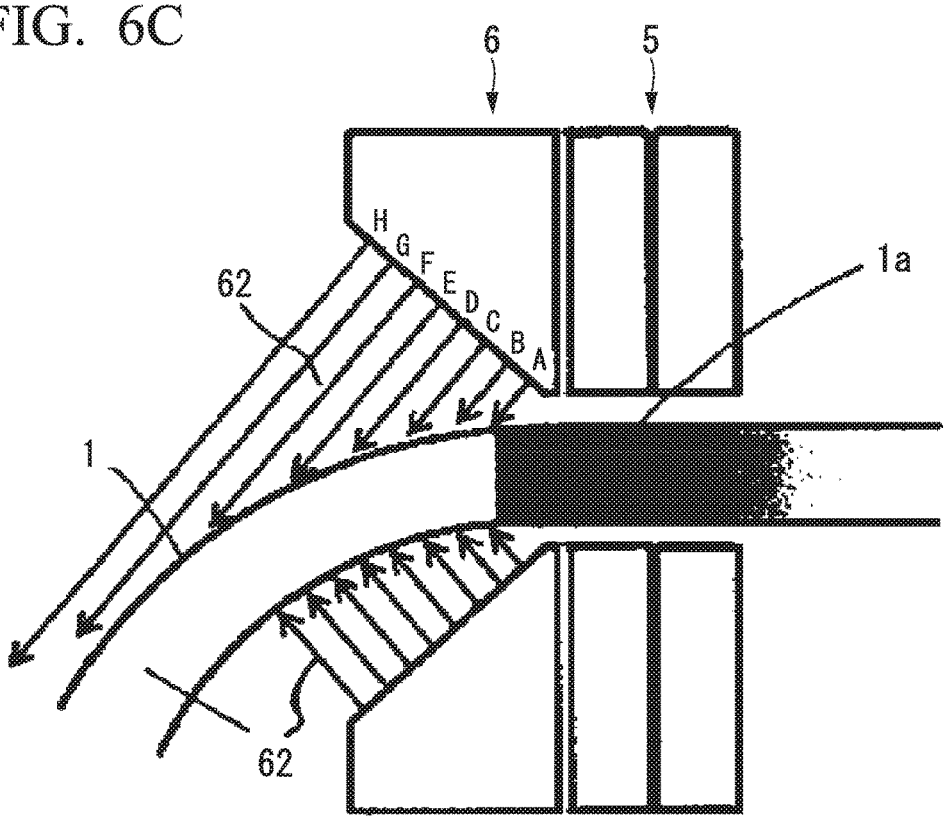
FIG. 6C is a plan view showing the state of cooling of the steel pipe by the cooling device in a case where the bending with the bending radius R is performed to the steel pipe.
Figure 6D:
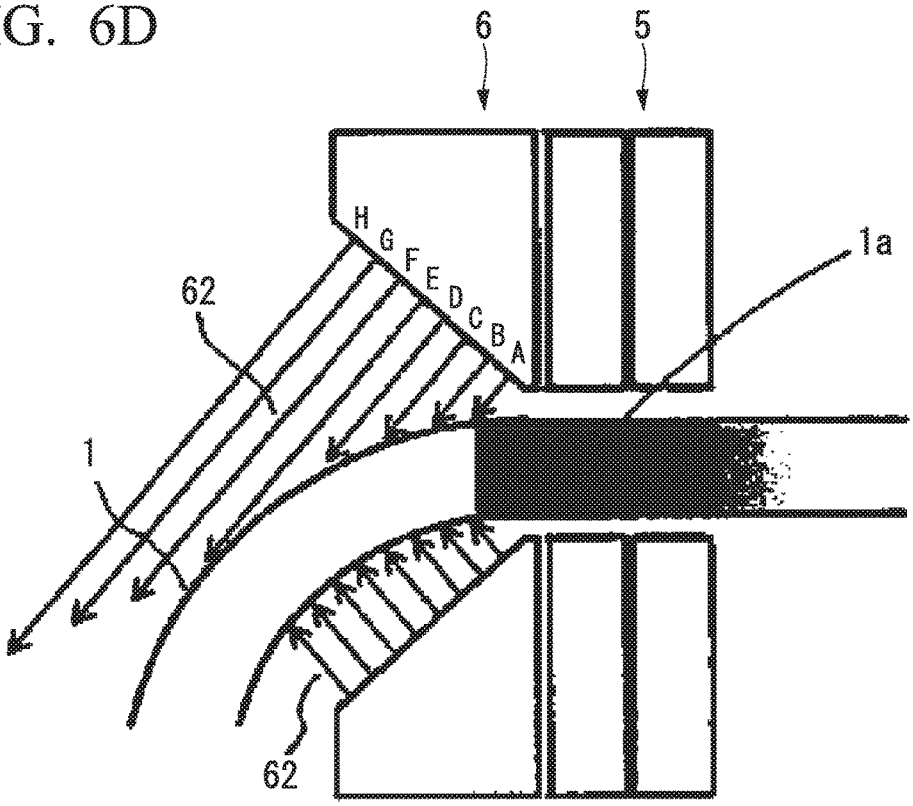
FIG. 6D is a plan view showing the state of cooling of the steel pipe by the cooling device in a case where the bending with the bending radius R is performed to the steel pipe.

Bending (bending condition 2) shown in FIG. 6C is described as an example. The angle of collision of the cooling medium 62 injected from the injecting holes 61 in the row F against the outside of the bent portion of the steel pipe 1 is extremely small. Moreover, the cooling medium 62 injected from the injecting holes 61 in the rows of G and H do not hit the outside of the bent portion of the steel pipe 1.

From the above-described reason, since the cooling of the steel pipe 1 by the cooling medium 62 injected from the rows F to H is insufficient, reheat occurs, and as shown in the bending condition 2 of FIG. 8, the surface temperature at the downstream side of the point F rises, as seen along the feed direction.

Meanwhile, as shown in FIG. 6C, the angle of collision of the cooling medium 62 injected from the injecting holes 61 in the rows F to H against the inside of the bent portion of the steel pipe 1 are large. For that reason, as shown in the bending condition 2 of FIG. 9, the inside of the bent portion the steel pipe 1 is sufficiently cooled by the cooling medium 62.

Figure 6E:
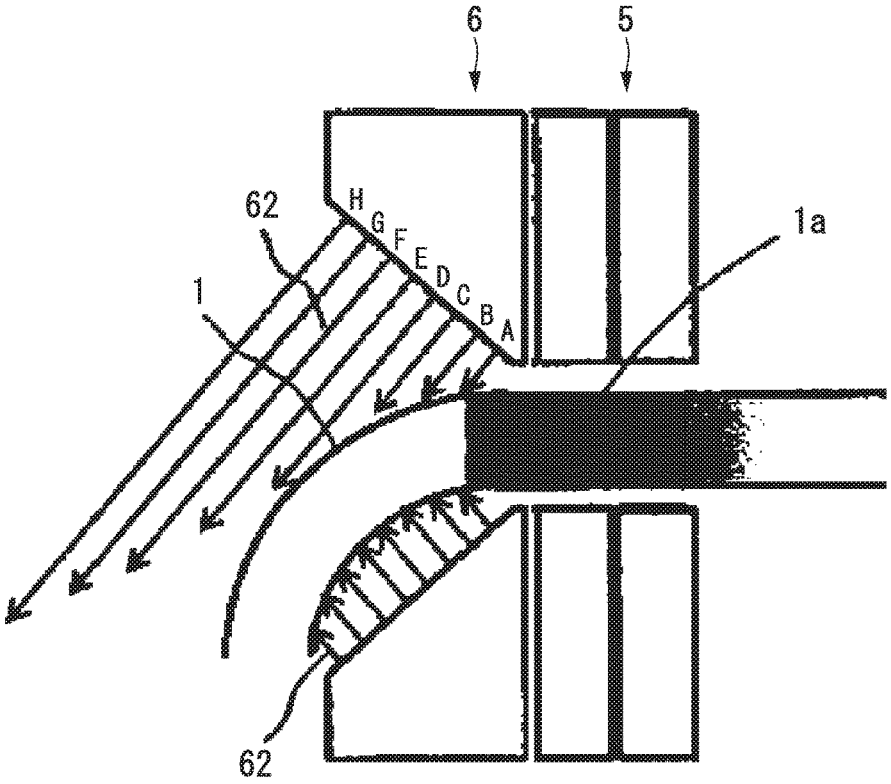
FIG. 6E is a plan view showing the state of cooling of the steel pipe by the cooling device in a case where the bending with the bending radius R is performed to the steel pipe.

Under the bending condition 4 in which the bending radius R is smaller than that under the bending condition 2, as shown in FIG. 6E, the cooling medium 62 injected from the rows A to C hit the outside of the bent portion of the steel pipe 1, but the cooling medium 62 injected from the rows D to H do not hit the outside of the bent portion of the steel pipe 1. For that reason, since the cooling of the steel pipe 1 is insufficient, reheat occurs, and as shown in the bending condition 4 of FIG. 8, the surface temperature on the downstream side of the point D rises, as seen along the feed direction.

Meanwhile, as shown in FIG. 6E, the angle of collision of the cooling medium 62 injected from the injecting holes 61 in the rows D to H against an inside surface of the bent portion of the steel pipe 1 are large. For that reason, as shown in the bending condition 4 of FIG. 9, the inside of the bent portion the steel pipe 1 is sufficiently cooled by the cooling medium 62.

As described above, in a case where bending with a small bending radius R is performed, the outside of the bent portion of the steel pipe 1 is cooled insufficiently. Therefore, a microstructure that has first been subjected to martensitic transformation as a result of quenching is tempered and softened at the outside of the bent portion of the steel pipe 1. Additionally, since the cooling of the outside of the bent portion of the steel pipe 1 is insufficient, a non-uniform structure is formed in a part of the outside of the bent portion.

Hence, in a case where bending with a small bending radius R is performed, the bent member 8 manufactured by the 3DQ is not cured because not only the hardness of the inside and the outside of the bent portion are non-uniform but also quenching that is one of the purposes of heating and cooling is not appropriately performed. Additionally, since a relatively high residual stress is generated in the bent member 8 due to the cooling of the inside and the outside of the bent portion being non-uniform, desired product performance may not be obtained when high fatigue strength is required to the bent member 8.

In addition, in the above description, a case where the sectional shape of the steel pipe 1 is circular has been described as an example. However, the problem that the cooling of the inside and the outside of the bent portion is non-uniform is similarly caused irrespective of the sectional shape of the steel pipe 1, for example, even in a case where the steel pipe 1 has a rectangular sectional shape, a flat sectional shape, a polygon sectional shape, or more complicated sectional shapes.

As one of methods for reducing the above-described non-uniformity of cooling, it is considered that not only the above-described cooling device 6 but also a cooling device capable of injecting the cooling medium 62 in correspondence with various bending shapes is used. However, in this method, there is a possibility that a injecting region for the cooling medium 62 may come into contact with the steel pipe 1. In addition, this method is not preferable from a viewpoint of economical efficiency.

As another method for reducing the above-described non-uniformity of cooling, a method for slowing down the feeding speed of the steel pipe 1 is considered. Since long time is required to pass the points A to H by slowing down the feeding speed of the steel pipe 1, a larger amount of the cooling medium 62 is injected to the surface of the steel pipe 1. For that reason, since the cooling medium 62 is also sufficiently injected to the outside of the bent portion of the steel pipe 1, the non-uniformity of cooling between the outside and the inside of the bent portion does not easily occur.

However, since the productivity of bending falls by slowing down the feeding speed of the steel pipe 1, this method is not preferable.

Additionally, in a case where bending with a small bending radius is performed, occurrence of wrinkle and cross-sectional distortion is a problem.

When the bent member 8 is manufactured with the steel pipe 1 as a material by a cold draw bender, it is general to insert a mandrel into an inner surface of the steel pipe 1 to perform bending, in order to suppress wrinkle and cross-sectional distortion (flattening) in the bent member 8.

On the other hand, in the 3DQ, generally, it is possible to suppress wrinkle and cross-sectional distortion more than the cold draw bender without constraining the inner surface of the steel pipe 1 by a mandrel or the like. In the 3DQ, the length of the high-temperature portion 1*a* in the longitudinal direction, which is formed in the steel pipe 1, is extremely short. Accordingly, since the high-temperature portion 1*a* is constrained due to a low-temperature portion that is present on both sides in the longitudinal direction of the high-temperature portion 1*a*, wrinkle and cross-sectional distortion resulting from bending are suppressed.

However, when the bending radius of the steel pipe 1 is small, wrinkle and cross-sectional distortion occurs remarkably. For that reason, in a case where the bending radius of the steel pipe 1 is small, it is necessary to suppress wrinkle and cross-sectional distortion even in a case where bending is performed to the steel pipe 1 using the 3DQ.

[Control Device (Controller)]

According to the above-described results of study, the control device (not shown) related to the present embodiment performs a control such that the feeding speed of the steel pipe 1 is set to be slower than V1 and the high-frequency power is set to be lower than Q1 in the bending step while forming the bent portion of which a ratio R/W is equal to or lower than a predetermined value, in a case where V1 is the feeding speed of the steel pipe 1 while forming the bent portion of which the ratio R/W is more than the predetermined value, Q1 is the high-frequency power supplied to the induction heating mechanism 5 while forming the high-temperature portion 1*a* on the steel pipe 1, and R/W is the ratio obtained by dividing the bending radius R [mm] of the bent portion on the centroid line of the steel pipe 1 by the dimension W [mm] in the bend direction in the cross-section of the steel pipe 1 orthogonal to the centroid line.

In addition, the dimension in the bend direction in the cross-section of the steel pipe 1 orthogonal to the centroid line means the width dimension of the steel pipe 1 when the bent portion is seen from the sight line along the centerline of curvature of bending thereof.

In addition, although a case where the dimension W of the steel pipe 1 does not vary in the longitudinal direction but has the same width dimension W is shown in FIGS. 7A to 7F, in a case where the dimension W of the steel pipe 1 varies in the longitudinal direction, the dimension W of the steel pipe 1 is determined for each bent portion of which R/W is determined.

It is preferable that the predetermined value of R/W is a value selected from within a range of 3.0 to 8.0. By setting the predetermined value of R/W to the value selected from within the range of 3.0 to 8.0 to control manufacture of the bent member 8 with the control device (not shown), productivity can be suitably improved while suitably suppressing uneven quenching, wrinkle, and cross-sectional distortion. It is more preferable that the above-described predetermined value of R/W is a value selected from within a range of 4.0 to 7.0.

In addition, a case where R/W is more than the predetermined value includes a case where a bent portion of which R/W is more than the predetermined value is formed and a case where a region in which bending is not performed is formed. In addition, in the present embodiment, a region in which bending is not performed is referred to as a straight pipe portion, and R/W while forming this straight pipe portion is supposed to be infinite.

In the control device (not shown) of the present embodiment, it is preferable to lower the feeding speed of the steel pipe 1 to 25% to 75% of the above-described V1 in a case where R/W is equal to or lower than the predetermined value.

By lowering the feeding speed of the steel pipe 1 to 25% to 75% of V1, the cooling medium 62 can be sufficiently injected to the outside of the bent portion even in a case where the bending radius is small. Thus, the outside of the bent portion can be appropriately cooled.

Additionally, by lowering the feeding speed of the steel pipe 1 to 25% to 75% of V1, the steel pipe 1 is uniformly cooled in the circumferential direction thereof, and a deformation zone becomes uniform in the circumferential direction. As a result, occurrence of wrinkle and cross-sectional distortion is suppressed.

In the control device (not shown) of the present embodiment, it is preferable to lower the high-frequency power supplied to the induction heating device 5 to 25% to 75% of the above-described Q1 in a case where R/W is equal to or lower than the predetermined value.

In the present embodiment, as described above, the high-frequency power supplied to the induction heating device 5 is controlled such that the highest arrival temperature of the steel pipe 1 becomes 900° C. to 1050° C. However, by lowering the feeding speed of the steel pipe 1, there is a case where the steel pipe 1 is superfluously heated and the steel material melts, or a case where grain coarsening of the steel material proceeds and a decrease in the toughness of the steel material occurs. By lowering the high-frequency power supplied to the induction heating device 5 to 25% to 75% of Q1, the steel pipe 1 can be prevented from being superfluously heated.

The method for changing the feeding speed of the steel pipe 1 and the high-frequency power supplied to the induction heating device 5 on the basis of the above-described R/W when bending of the steel pipe 1 is performed is the knowledge that has been first found out by the present invention.

Additionally, the control device (not shown) just has to be control devices that can perform the above-described control, and is not particularly limited.

(Method for Manufacturing Bent Member)

Next, the method for manufacturing the bent member 8 using the hot-bending apparatus 0 for a steel material related to the present embodiment will be described.

The method for manufacturing the bent member 8 related to the present embodiment has a gripping step, a feeding step, a heating step, a bending step, and a cooling step.

In the gripping step, at least one of the one end portion (tip portion) and the other end portion (rear end portion) of the steel pipe 1 is gripped by the gripping device 7.

In the feeding step, the steel pipe 1 after the gripping step is relatively fed in the longitudinal direction with respect to the induction heating device 5 and the cooling device 6. That is, in the feeding step, the steel pipe 1 may be fed in the longitudinal direction with respect to the induction heating device 5 and the cooling device 6, or the induction heating device 5 and the cooling device 6 may be fed in the longitudinal direction of the steel pipe 1.

In the heating step, the high-temperature portion 1*a* is formed by performing high-frequency induction heating on one portion of the steel pipe 1 in the longitudinal direction. In the heating step, the highest arrival temperature of the steel pipe 1 is controlled by controlling the high-frequency power supplied to the induction heating device 5.

In the bending step, a bending moment in an arbitrary direction is applied to the high-temperature portion 1*a*. Accordingly, a bent portion is formed on the steel pipe 1.

In the cooling step, the bent portion is cooled by injecting the cooling medium 62 to the bent portion.

The control device (not shown) for manufacturing the bent member 8 related to the present embodiment performs a control such that the feeding speed of the steel pipe 1 is set to be slower than V1 and the high-frequency power is set to be lower than Q1 while forming the bent portion of which the ratio R/W is equal to or lower than the predetermined value, in a case where V1 is the feeding speed of the steel pipe 1 while forming the bent portion of which the ratio R/W is more than the predetermined value, Q1 is the high-frequency power supplied to the induction heating device 5 while forming the high-temperature portion 1*a* on the steel pipe 1, and R/W is the ratio obtained by dividing the bending radius R [mm] of the bent portion on the centroid line of the steel pipe 1 by the dimension W [mm] in the bend direction in the cross-section of the steel pipe 1 orthogonal to the centroid line.

In order to improve the productivity preferably and to suppress uneven quenching, wrinkle, and cross-sectional distortion, it is preferable that the above-described predetermined value of R/W is a value selected from within the range of 3.0 to 8.0. It is more preferable that the above-described predetermined value of R/W is a value selected from within a range of 4.0 to 7.0.

As described above, according to the present embodiment, even in a case where the bent member 8 having a small bending radius R is manufactured, it is possible to suppress occurrence of uneven quenching, wrinkle, and cross-sectional distortion, and to manufacture the bent member 8 with excellent productivity.

Additionally, according to the present embodiment, it is possible to manufacture the bent member 8 using the related-art cooling device 6 that is used in the 3DQ without using an exclusive cooling device 6. For that reason, this is suitable from a viewpoint of economical efficiency.

In addition, the present invention is not limited only to the above-described embodiment.

For example, in the above-described embodiment, the method for manufacturing the bent member 8 having the bent portion of which R/W is equal to or lower than the predetermined value was described. However, in cases where R/W of all bent portions included in the bent member 8 are more than the predetermined value, even if the related art method for manufacturing the bent member 8, it is possible to suppress occurrence of uneven quenching, wrinkle, and cross-sectional distortion, and a decrease in productivity does not occur, either. For that reason, in cases where R/W of all bent portions included in the bent member 8 are more than the predetermined value, it is not necessary to lower the feeding speed of the steel pipe 1 relative to the cooling device 6, and the high-frequency power supplied to the induction heating device 5.

EXAMPLE 1

As shown in FIG. 6A, only quenching was performed without performing bending to a steel pipe, and a feeding speed $V_0$ at which suitable hardness (420 Hv or more) and suitable surface residual stress (surface residual stress measured by an the X-ray diffraction method is equal to or lower than 80 MPa at tensile residual stress) were obtained was determined using the hot-bending apparatus for a steel material of the present embodiment. The feeding speed $V_0$ determined as described above was used as a reference feeding speed.

Bending was performed to the steel pipe while feeding the steel pipe at the reference feeding speed $V_0$. In that case, the bending radius R was changed, and a relationship between the bending radius R and the acceptance rate of quality was investigated.

As for evaluation of the quality, a case where the suitable hardness (420 Hv or more) and the suitable surface residual stress (the surface residual stress measured by the X-ray diffraction method is equal to or lower than 80 MPa at tensile residual stress) were obtained was considered to be acceptable. Then, bending tests were performed 20 times for each bending radius R, the hardness and the surface residual stress of obtained bent members were measured, and the acceptance rate of quality was determined. In addition, all the tests were performed such that wrinkle did not occur. Test results are shown in Table 1.

TABLE 1

| (Bending Radius R/Width Dimension W) | Acceptance Rate of Quality |
|---|---|
| R/W > 15.0 | 100% |
| 15.0 ≥ R/W > 10.0 | 100% |
| 10.0 ≥ R/W > 8.0 | 98% |
| 8.0 ≥ R/W > 5.5 | 92% |
| 5.5 ≥ R/W > 3.0 | 88% |
| 3.0 ≥ R/W > 2.0 | 61% |
| 2.0 ≥ R/W > 1.5 | 47% |

As shown in Table 1, in a case where R/W was equal to or lower than 8.0, the acceptance rate of quality decreased compared to a case where R/W is more than 8.0. Particularly in a case where R/W was equal to or lower than 3.0, the acceptance rate of quality decreased compared to a case where R/W is more than 3.0.

The acceptance rate of quality with respect to R/W in a case where the steel pipe was fed at the reference feeding speed $V_0$ is shown in Table 1. The acceptance rate of quality with respect to R/W in a case where the steel pipe was fed at a speed slower than the reference feeding speed $V_0$ is shown in Table 2. As shown in Table 2, as the feeding speed, feeding speeds of 75%, 50%, and 25% of the reference feeding speed $V_0$ were used.

TABLE 2

| (Bending | Acceptance Rate of Quality | | |
|---|---|---|---|
| Radius R/Width Dimension W) | $0.75 \times V_0$ | $0.50 \times V_0$ | $0.25 \times V_0$ |
| R/W > 15.0 | — | — | — |
| 15.0 ≥ R/W > 10.0 | — | — | — |
| 10.0 ≥ R/W > 8.0 | 100% | — | — |
| 8.0 ≥ R/W > 5.5 | 97% | 100% | — |
| 5.5 ≥ R/W > 3.0 | 96% | 98% | 100% |
| 3.0 ≥ R/W > 2.0 | 88% | 94% | 100% |
| 2.0 ≥ R/W > 1.5 | 73% | 85% | 98% |

As shown in Table 2, the acceptance rate of quality was improved by lowering the feeding speed of the steel pipe 1.

EXAMPLE 2

A bent member having a shape shown in FIG. 13 was manufactured by the 3DQ, using a carbon steel pipe (C content 0.2 mass %) with a width dimension of 25.4 mm and a thickness of 1.8 mm. The feeding speed of a steel pipe and the high-frequency power supplied to the induction heating device when manufacturing a bent member were changed, and the presence/absence of occurrence of wrinkle and working time were investigated. Results relating to Example 2-1, Comparative Example 2-1, and Comparative Example 2-2 are shown in Table 3.

In addition, in Example 2-1, Comparative Example 2-1, and Comparative Example 2-2, the high-frequency power supplied to the induction heating device was adjusted such that the highest arrival temperature of the steel pipes was 1000° C.

TABLE 3

| | Bending Radius R [mm] | $V_0$ [mm/s] | $V_B$ [mm/s] | $E_0$ [kW] | $E_B$ [kW] | Occurrence of Wrinkle | Working Time [s] |
|---|---|---|---|---|---|---|---|
| Comparative Example 2-1 | 90 | 80 | — | 128.8 | — | Yes | 27 |
| Comparative Example 2-2 | 90 | — | 30 | — | 48.3 | No | 73 |
| Example 2-1 | 90 | 80 | 30 | 128.8 | 48.3 | No | 33 |

COMPARATIVE EXAMPLE 2-1

Comparative Example 2-1 in Table 3 represents a related-art example, and bending was performed to a steel pipe according to the feeding speed of the steel pipe shown in FIG. 11A and the supply of high-frequency power to the induction heating device shown in FIG. 11B. Specifically, a feeding speed $V_0$ of the steel pipe was set to 80 mm/sec, and high-frequency power $E_0$ supplied to the induction heating device was set to 128.8 kW.

In a bent member manufactured by Comparative Example 2-1, a crease of about 0.6 mm was generated on an inside surface of a bent portion. Moreover, it was understood that, according to the observation of the outside surface of the bent portion, a non-uniform tempered structure was generated in part. The hardness of the above-described tempered structure was about 350 Hv, and was softened as compared to a hardness of about 450 Hv of a straight pipe portion. Additionally, when the residual stress on an outer peripheral side of the bent portion was measured with X rays, the residual stress was tensile residual stress more than 80 MPa.

COMPARATIVE EXAMPLE 2-2

Comparative Example 2-2 shown in Table 3 represents a related-art example, and bending was performed to a steel pipe using the feeding speed of the steel pipe shown in FIG. 12A and the supply of high-frequency power to the induction heating device shown in FIG. 12B. Specifically, a feeding speed $V_B$ of the steel pipe was set to 30 mm/sec, and high-frequency power $E_B$ supplied to the induction heating device was set to 48.3 kW.

In a bent member manufactured by Comparative Example 2-2, a crease or a non-uniform tempered structure was not generated on the inside of the bent portion. Additionally, suitable hardness of about 450 Hv was obtained in the overall longitudinal direction of the steel pipe including the bent portion. Additionally, when the residual stress of the outside of the bending was measured with X rays, similar to the straight pipe portion, suitable compressive residual stress that was about −50 MPa was obtained in the overall longitudinal direction.

However, in Comparative Example 2-2, the time required for bending was 73 seconds which was about 2.7 times of that of Comparative Example 1, and a decrease in productivity was remarkable.

EXAMPLE 2-1

Example 2-1 shown in Table 3 represents an example of the present invention, and bending was performed to a steel pipe using the feeding speed of the steel pipe shown in FIG. 14A and the supply of high-frequency power to the induction heating device shown in FIG. 14B.

In Example 2-1, the feeding speed $V_0$ of the steel pipe when a portion that is scheduled to be a straight pipe portion passed through the induction heating device and the cooling device was set to 80 mm/sec. Additionally, the high-frequency power $E_0$ supplied to the induction heating device when heating the portion that is scheduled to be the straight pipe portion was set to 128.8 kW.

Meanwhile, the feeding speed $V_B$ of the steel pipe when a portion that is scheduled to be a bent portion passed through the induction heating device and the cooling device was set to 30 mm/sec. Additionally, the high-frequency power $E_B$ supplied to the induction heating device when heating the portion that is scheduled to be the bent portion was set to 48.3 kW.

In addition, in Example 2-1, the high-frequency power supplied to the induction heating device when heating a region where the feeding speed shifts from $V_0$ to $V_B$ and a region where the feeding speed shifts from $V_B$ to $V_0$ was controlled such that the highest arrival temperature of the steel pipe was 1000° C., on the basis of preliminary experimental results using a thermocouple.

In a bent member manufactured by Example 2-1, a crease or a non-uniform tempered structure was not generated in the bent portion. Additionally, excellent hardness of about 450 Hv was obtained in the overall longitudinal direction of the steel pipe including the bent portion. Additionally, suitable residual stress was obtained. Moreover, in Example 2-1, the time required for working was 33 seconds, and this was about 1.2 times even if it is compared with Comparative Example 2-1.

From the above results, suitable hardness, residual stress, and productivity could be obtained in Example 2-1, without generating a crease or a non-uniform tempered structure.

INDUSTRIAL APPLICABILITY

According to the above embodiments, it is possible to provide a method for manufacturing a bent member and a hot-bending apparatus for a steel material that can reduce occurrence of uneven quenching and occurrence of wrinkle and cross-sectional distortion and is excellent in productivity and economical efficiency, even in a case where a bent member having a small bending radius is manufactured.

BRIEF DESCRIPTION OF THE REFERENCE SYMBOLS

0: BENDING DEVICE (HOT-BENDING APPARATUS FOR STEEL MATERIAL)

1: STEEL PIPE (STEEL MATERIAL)
1*a*: HIGH-TEMPERATURE PORTION (RED HEAT PORTION)
2: SUPPORTING DEVICE
3: FEEDING DEVICE (FEEDING MECHANISM)
4: MOVABLE ROLLER DIE
5: INDUCTION HEATING DEVICE (INDUCTION HEATING MECHANISM)
6: COOLING DEVICE (COOLING MECHANISM)
7: GRIPPING DEVICE (GRIPPING MECHANISM)
8: BENT MEMBER
61: INJECTING HOLE
62: COOLING MEDIUM

What is claimed is:

1. A method for manufacturing a bent member, the method comprising:

feeding an elongated steel material in a longitudinal direction with one end portion of the steel material as a head;

performing high-frequency induction heating to one portion of the steel material in the longitudinal direction by being supplied high-frequency power to form a high-temperature portion;

bending the steel material by applying a bending moment in an arbitrary direction to the high-temperature portion to form a bent portion, the bending comprising:

forming the bent portion having a ratio R/W which is equal to or lower than a predetermined value, where the ratio R/W is a ratio obtained by dividing a bending radius R [mm] of the bent portion on a centroid line of the steel material by a dimension W [mm] in a bend direction in a cross-section of the steel material orthogonal to the centroid line;

slowing down a feeding speed (V1) of the steel material, where the V1 is the feeding speed of the steel material while forming the bent portion having the ratio R/W which is more than the predetermined value;

reducing the high-frequency power (Q1) supplied while forming the high-temperature portion, where the Q1 is the high-frequency power supplied while forming the bent portion having the ratio R/W which is more than the predetermined value; and injecting a cooling medium to the bent portion to cool the bent portion, and the feeding of the elongated steel material, the performing of high-frequency induction heating, the bending of the steel material and the injecting of a cooling medium occurs as the steel material is moving.

2. The method for manufacturing a bent member according to claim 1, wherein the predetermined value of the ratio R/W is within a range of 3.0 to 8.0.

3. The method for manufacturing a bent member according to claim 1, wherein a feeding speed (V1) of the steel material while forming the bent portion having the ratio R/W which is equal to or lower than the predetermined value is lowered to 25% to 75% of the V1 during bending.

4. The method for manufacturing a bent member according to claim 1, wherein the high-frequency power (Q1) supplied while forming the bent portion having the ratio R/W which is equal to or lower than the predetermined value is lowered to 25% to 75% of the Q1 during bending.

* * * * *